US011705289B2

(12) United States Patent
Friedrichsen et al.

(10) Patent No.: US 11,705,289 B2
(45) Date of Patent: Jul. 18, 2023

(54) SWITCHING DEVICE AND SWITCHING ARRANGEMENT

(71) Applicant: Eaton Intelligent Power Limited, Dublin (IE)

(72) Inventors: Lutz Friedrichsen, Dueren (DE); Volker Lang, Bonn (DE); Johannes Meissner, Bonn (DE); Julia Otte, Cologne (DE); Madeline Philipsohn, Eitorf (DE); Gerd Schmitz, Niederkassel (DE); Kai Schroeder, Niederkassel (DE); Ute Molitor, Bad Neuenahr-Ahrweiler (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 68 days.

(21) Appl. No.: 17/261,204

(22) PCT Filed: Jul. 15, 2019

(86) PCT No.: PCT/EP2019/069006
§ 371 (c)(1),
(2) Date: Jan. 19, 2021

(87) PCT Pub. No.: WO2020/016179
PCT Pub. Date: Jan. 23, 2020

(65) Prior Publication Data

US 2021/0272758 A1 Sep. 2, 2021

(30) Foreign Application Priority Data

Jul. 20, 2018 (GB) ..... 1811874

(51) Int. Cl.
*H01H 1/20* (2006.01)
*H01H 9/36* (2006.01)
(Continued)

(52) U.S. Cl.
CPC ..... *H01H 1/20* (2013.01); *H01H 9/36* (2013.01); *H01H 9/443* (2013.01);
(Continued)

(58) Field of Classification Search
CPC ..... H01H 1/20; H01H 9/36; H01H 9/443; H01H 33/187; H01H 50/58; H01H 2009/365; H01H 9/46; H01H 50/546
See application file for complete search history.

(56) References Cited

U.S. PATENT DOCUMENTS 5,004,874 A * 4/1991 Theisen ..... H01H 9/443 218/151
5,864,453 A * 1/1999 Wieloch ..... H01H 77/10 361/93.6
(Continued)

FOREIGN PATENT DOCUMENTS

CN 206060162 U 3/2017
EP 2551867 A1 1/2013
(Continued)

*Primary Examiner* — Bernard Rojas
(74) *Attorney, Agent, or Firm* — Leydig, Voit & Mayer Ltd.

(57) ABSTRACT

A switching device includes: a first and a second fixed contact; a contact bridge; a first movable contact and a second movable contact that are arranged at the contact bridge; a first terminal contact on which the first fixed contact is mounted; and a second terminal contact on which the second fixed contact is mounted. The first fixed contact
(Continued)

is in contact with the first movable contact and the second fixed contact is in contact with the second movable contact in a switched-on state of the switching device. The first fixed contact is free of contact with the first movable contact and the second fixed contact is free of contact with the second movable contact in a switched-off state of the switching device. A path of a load current flowing through the contact bridge between the first and second movable contacts in the switched-on state extends in a first plane.

19 Claims, 12 Drawing Sheets

(51) Int. Cl.
*H01H 9/44* (2006.01)
*H01H 33/18* (2006.01)
*H01H 50/58* (2006.01)

(52) U.S. Cl.
CPC ..... *H01H 33/187* (2013.01); *H01H 50/58* (2013.01); *H01H 2009/365* (2013.01)

(56) References Cited

U.S. PATENT DOCUMENTS

| | | | | |
|---|---|---|---|---|
| 6,700,466 | B1 * | 3/2004 | Yamamoto | H01H 9/302 335/201 |
| 7,145,422 | B2 * | 12/2006 | Imanishi | H01H 9/443 335/133 |
| 8,228,144 | B2 * | 7/2012 | Sugisawa | H01H 50/00 335/78 |
| 8,698,582 | B2 * | 4/2014 | Uchida | H01H 51/06 335/131 |
| 8,816,803 | B2 * | 8/2014 | Naka | H01H 1/50 335/133 |
| 11,270,852 | B2 * | 3/2022 | Mori | H01H 1/54 |
| 2007/0076341 | A1 | 4/2007 | Battani et al. | |
| 2014/0151338 | A1 | 6/2014 | Gerving et al. | |
| 2014/0175057 | A1 | 6/2014 | Gerving et al. | |
| 2015/0311019 | A1 | 10/2015 | Cech et al. | |

FOREIGN PATENT DOCUMENTS

| | | | |
|---|---|---|---|
| EP | 2590192 | A1 | 5/2013 |
| EP | 2747109 | A1 | 6/2014 |
| EP | 2975625 | A1 | 1/2016 |
| EP | 2946396 | B1 | 6/2017 |

* cited by examiner

SWITCHING DEVICE AND SWITCHING ARRANGEMENT

CROSS-REFERENCE TO PRIOR APPLICATIONS

This application is a U.S. National Phase application under 35 U.S.C. § 371 of International Application No. PCT/EP2019/069006, filed on Jul. 15, 2019, and claims benefit to British Patent Application No. GB 1811874.5, filed on Jul. 20, 2018. The International Application was published in English on Jan. 23, 2020 as WO 2020/016179 under PCT Article 21(2).

FIELD

The present disclosure is related to a switching device and a switching arrangement with a switching device.

BACKGROUND

A switching arrangement comprises a switching device. The switching device comprises a switching portion that is often called a breaker and an actuating portion that is often called a relay. A relay may also switch a current that is in most cases a small current.

The disclosure is related to a switching device for switching DC currents, especially for higher DC currents. The switching device and the switching arrangement may be used in the field of electric mobility.

Document EP 2551867 A1 describes a switch for DC operation that comprises a first and a second fixed contact, a contact bridge, a first and a second movable contact and a first and a second terminal contact on which the first and the second fixed contact are mounted. A path of a load current that flows through the contact bridge between the first and the second movable contact in the switched-on state extends in a first plane, wherein a movement of the contact bridge between the switched-on state and the switched-off state is perpendicular to the first plane. A main direction of the first terminal contact under the first fixed contact is parallel to a main direction of the second terminal contact under the second fixed contact.

Document EP 2975625 A1 elucidates a relay including a first and a second fixed contact and a contact bridge called movable contact. A magnetic field generated by magnets is used to provide a force on an arc. The contact bridge is bended twice.

Document U.S. Pat. No. 5,004,874 refers to a direct current switching apparatus comprising two teardrop-shaped conductors on which a first and second stationary contact tip are affixed, a movable bridging contact with movable contacts, splitter plates with varying lengths and magnets. The movable bridging contact has a three-dimensional form.

Document EP 2590192 A1 describes a switch for multi-pole direct-current operation. The switch includes a first and a second fixed contact and a contact bridge which has a rectangular form in a top view.

Document EP 2747109 A1 refers to a switching device having a first and a second fixed contact, a contact bridge, a first and a second movable contact arranged on the contact bridge and a first and a second terminal contact. The contact bridge has a rectangular form.

Document WO 2014/111439 A1 is related to a safety switching device. A control device receives signals from a safety door switch and from an emergency stop button and provides control signals to two protective devices. The two protective devices are connected in series and supply a robot or an electrical installation with electrical energy.

SUMMARY

In an embodiment, the present invention provides a switching device, comprising: a first fixed contact; a second fixed contact; a contact bridge; a first movable contact and a second movable contact that are arranged at the contact bridge; a first terminal contact on which the first fixed contact is mounted; and a second terminal contact on which the second fixed contact is mounted, wherein the first fixed contact is in contact with the first movable contact and the second fixed contact is in contact with the second movable contact in a switched-on state of the switching device, wherein the first fixed contact is free of contact with the first movable contact and the second fixed contact is free of contact with the second movable contact in a switched-off state of the switching device, wherein a path of a load current that flows through the contact bridge between the first movable contact and the second movable contact in the switched-on state extends in a first plane, wherein a movement of the contact bridge between the switched-on state and the switched-off state has a direction that is perpendicular to the first plane, wherein the load current that flows through the contact bridge between the first movable contact and the second movable contact in the switched-on state has at least one path comprising an S-shaped path, a zig-zag path, a meander path, a Z-shaped path, a C-shape, a path comprising two connected semicircles, or a path twice curved in opposite directions, wherein a main direction of the first terminal contact is parallel to a main direction of the second terminal contact, wherein a straight line drawn between the first movable contact and the second movable contact is across the main direction of the first terminal contact, and wherein the load current that flows through the first terminal contact, a first arc generated between the first fixed contact and the first movable contact at a transition between the switched-on state and the switched-off state of the switching device, and a first outer part of the contact bridge has a U-form.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
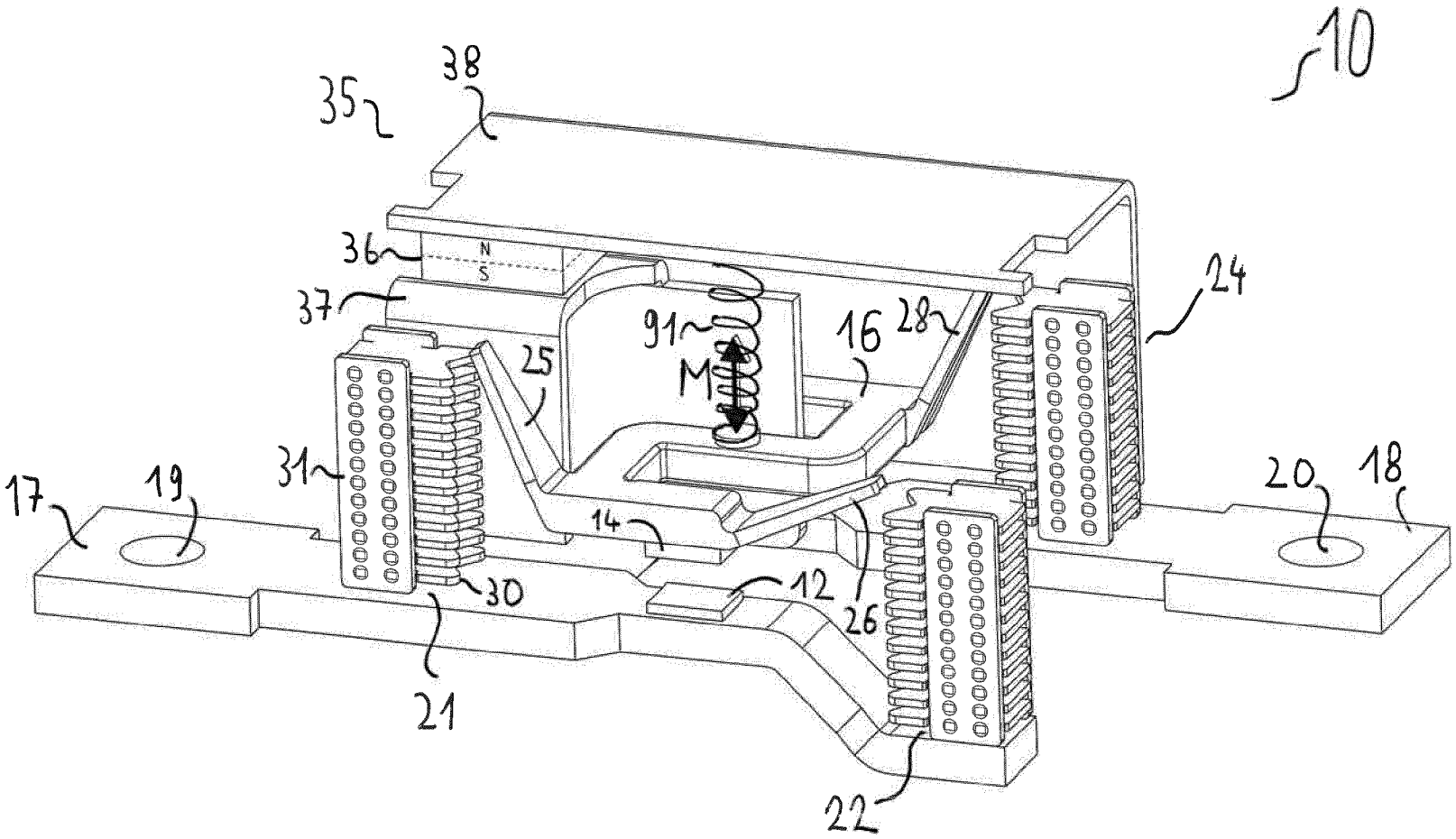
FIGS. 1A to 1E show examples of a switching device and examples of a contact bridge.

In an embodiment, the present invention provides a switching device and a switching arrangement that is able to operate with higher currents.

The definitions as described above also apply to the following description unless otherwise stated.

In an embodiment, a switching device comprises a first and a second fixed contact, a contact bridge, and a first and a second movable contact that are arranged at the contact bridge. The first fixed contact is in contact to the first movable contact and the second fixed contact is in contact to the second movable contact in a switched-on state of the switching device. The first fixed contact is free of a contact to the first movable contact and the second fixed contact is free of a contact to the second movable contact in a switched-off state of the switching device. A load current that flows through the contact bridge between the first and the second movable contact in the switched-on state has a curved path.

Advantageously, the contact bridge is formed such that a high load current generates a magnetic field that improves a blowout of arcs at a transition from the switched-on state to the switched-off state. The load current has the curved path in a top view on the contact bridge.

In an embodiment, the contact bridge has a form of a group consisting of a S-shape, a zig-zag, a meander, a Z-shape, a C-shape, two connected semicircles and a form twice curved in opposite directions. The form is seen in the top view on the contact bridge.

In an embodiment, the load current that flows through the contact bridge between the first and the second movable contact in the switched-on state has at least one path of a group consisting of a S-shaped path, a zig-zag path, a meander path, a Z-shaped path, a path comprising two connected semicircles and a path twice curved in opposite directions, especially in the top view on the contact bridge. The load current that flows through the contact bridge may flow in or inside the contact bridge.

In an embodiment, the path of the load current that flows through the contact bridge between the first and the second movable contact in the switched-on state first extends in a first direction, then in a second direction that is opposite to the first direction and then again in the first direction.

In an embodiment, the load current that flows through the contact bridge in the switched-on state flows from the first movable contact in a first direction, then turns in a second direction that is opposite to the first direction and then turns again in the first direction and flows to the second movable contact.

The load current may be negative or positive. The load current may be e.g. a DC current and/or an AC current. Certain aspects of the present disclosure may not be applicable to an AC current embodiment, as will be understood.

In an embodiment, the path of the load current that flows through the contact bridge between the first and the second movable contact in the switched-on state first extends or approximately extends in a first plane. It will be understood that the load current flowing through the contact bridge between the first and second moveable contacts can vary from a planar arrangement, as described throughout the present disclosure. A direction of a movement of the contact bridge between the switched-on state and the switched-off state is perpendicular to the first plane. It will be understood that the contact bridge can be moved in directions other than perpendicular, including nearly perpendicular (e.g., due to variances in the magnetic drive actuator motion and/or due to wear or degradation in the contacts over time), oblique, and/or any other arrangement. It can be seen that, while a perpendicular movement is efficient for contactor engagement and ease of design configuration, a non perpendicular movement can be compensated with appropriate arrangement of the permanent magnet system, arc extinguishing features, and other aspects of a switching arrangement as described throughout the present disclosure. The top view on the contact bridge is parallel to the direction of the movement of the contact bridge.

In an embodiment, the path of the load current that flows through the contact bridge between the first and the second movable contact in the switched-on state extends or approximately extends in the first plane. A surface of the contact bridge opposing the first and the second terminal contact may be flat or may comprise steps. Also in case of steps, the above described path of the load current at least approximately extends in the first plane.

In an embodiment, the switching device comprises a first pair of arc runners which are arranged at the contact bridge near the first movable contact and a second pair of arc runners which are arranged at the contact bridge near the second movable contact.

In an embodiment, the switching device comprises a first pair of arc extinguishing devices for extinguishing or blowout a first arc originating between the first fixed contact and the first movable contact and a second pair of arc extinguishing devices for extinguishing or blowout a second arc originating between the second fixed contact and the second movable contact.

In an embodiment, the switching device comprises a permanent magnet system comprising an inner and an outer pole plate and a permanent magnet that is arranged between the inner and the outer pole plate.

In an embodiment, the inner pole plate is at least partially U-shaped. The outer pole plate is at least partially U-shaped. The inner pole plate may have openings. The outer pole plate may have openings. Thus, a cross-section of the inner and the outer pole plate that is perpendicular to the inner and the outer pole plate shows two U-shapes at some parts of the pole plates but not at each part of the pole plates.

In an embodiment, the first fixed contact and the first movable contact are between the inner and the outer pole plate in the switched-on state and in the switched-off state of the switching device. The second fixed contact and the second movable contact are between the inner and the outer pole plate in the switched-on state and in the switched-off state of the switching device.

In an embodiment, the switching device comprises a first terminal contact on which the first fixed contact is mounted and a second terminal contact on which the second fixed contact is mounted. A main direction of the first terminal contact is parallel to a main direction of the second terminal contact. A straight line drawn between the first movable contact and the second movable contact is across the main direction of the first terminal contact, for example perpendicular to the main direction of the first terminal contact. The straight line is a virtual or imaginary line. Thus, the contact bridge is across or perpendicular to the first terminal contact and to the second terminal contact.

In an embodiment, the contact bridge comprises a first outer part on which the first movable contact is fixed and a second outer part on which the second movable contact is fixed.

In an embodiment, the first terminal contact, the first arc generated between the first fixed contact and the first movable contact at a transition between the switched-on state and the switched-off state and the first outer part of the contact bridge form a first magnetic field loop that blows the first arc in the direction of an arc extinguishing device. The load current that flows through the first terminal contact, the first arc and the first outer part has a U-form, especially in a side view. The U-form of the load current generates the first magnetic field loop. A direction of movement of the contact bridge is perpendicular to the direction of the side view.

In an embodiment, the second terminal contact, the second arc generated between the second fixed contact and the second movable contact at a transition between the switched-on state and the switched-off state and the second outer part of the contact bridge form a second magnetic field loop that blows the second arc in the direction of an arc extinguishing device. The load current that flows through the second terminal contact, the second arc and the second outer part has a further U-form. The further U-form of the load current generates the second magnetic field loop. The first and the second magnetic field loop are coupled.

In an embodiment, a switching arrangement comprises a switching device, a magnetic drive coupled to a contact bridge of the switching device, and a control circuit having a control input, an emergency input and at least one output coupled to the magnetic drive. The control circuit is configured to set the switching device in a switched-on state or in a switched-off state depending on a control signal provided to the control input. The control circuit is configured to set the switching device in a switched-off state depending on an emergency signal provided to the emergency input.

Advantageously, the switching arrangement sets the switching device in the switched-off state in case of an emergency signal independent of the control signal. Thus, the switching arrangement can handle emergency cases and can be used also for higher load currents. The emergency signal blocks the control signal from setting the switching device in the switched-on state.

The switching arrangement may comprise the switching device as described above or another switching device. Thus, a load current that flows through the contact bridge between the first and the second movable contact in the switched-on state may have a curved path, a straight path or another path.

In an embodiment, the control circuit comprises a current sensing unit for measuring the load current flowing through the switching device. The control circuit comprises a trigger level detector having an input coupled to an output of the current sensing unit and an output for generating a trigger signal. The control circuit is configured to set the switching device in a switched-off state as a function of the trigger signal.

In an embodiment, the switching arrangement comprises a power bus with a first and a second terminal. The first terminal is connected via the switching device to the second terminal. The current sensing unit may measure the load current flowing through the first and/or second terminal. The first and the second terminal may be realized as first and second terminal lead or first and second connection line.

In an embodiment, the switching arrangement comprises an auxiliary switch or auxiliary contacts. The magnetic drive is additionally coupled to the auxiliary switch or the auxiliary contacts. The auxiliary switch may be realized such as or similar to the switching device. For example, a common armature couples the magnetic drive to the contact bridge and to an auxiliary contact bridge of the auxiliary switch. The auxiliary contacts may e.g. use the contact bridge of the switching device.

In an embodiment, the control circuit comprises a control detector that is connected to two terminals of the auxiliary switch or the auxiliary contacts. The control detector detects whether the auxiliary switch or the auxiliary contacts is set in a switched-on state or in a switched-off state. The control detector may generate an information about an actual state of the switching device based on the information about the state of the auxiliary switch or the auxiliary contacts. The control detector may generate an error signal in case of a deviation of a target state of the switching device and the actual state of the switching device.

In an embodiment, the switching device combines a breaker and a relay. Electric vehicles and/or hybrid vehicles may use the switching device for conducting and switching of the regular operating currents of the electric propulsion or electric power drive and separate safety elements for fast switching in an emergency situation such as a crash or a short circuit. The switching device and the separate safety elements are used for current carrying and the safe isolation of the power supply between an energy storage and the supply system. These components are parts of a so-called high-voltage supply system on board and are configured for a nominal voltage of 400 V or higher. These components are arranged in a common safety box that is located in the vicinity of the energy storage. The common safety box may be realized as a power distribution unit, shorted PDU.

In an embodiment, the switching device is optionally realized as a remotely controlled and compact device. The switching device is designed for conducting a DC load current in the range above 100 A. The switching device is configured to switch the load current at a high voltage. A high voltage may be any voltage above 42 V, above 72 V, above 110 V, above 220 V, above 300 V, and/or above 360 V. During normal operation, sometimes named nominal rating, a power electronics of the vehicle limits a load current that has to be switched up to ca. 30 A, with a minimum number of switching operations of typically 100000. In case of an overload or short circuits at currents up to several kA, the switching device is configured only for a significantly lower number of switching operations.

In an embodiment, a permanent magnet system of the switching device is configured to blow out arcs that are generated at the switching of DC currents with several 100 V. The permanent magnet system may be realized as a magnetic field arrangement or permanent magnetic field arrangement in such an arrangement, magnetic field, that can also be named magnetic blow out field, acts on the arc that is generated. The magnetic field results in a bulging of the column of the arc and in a movement away from the switching contacts. The switching contacts are a fixed and a movable contact of the switching device. Since the length of the arc is increased, the arc is cooled by the switching gas surrounding the arc. This results in an increase of a voltage of the arc and the arc is extinguished when the driving voltage is obtained. The switching gas optionally may consist of hydrogen or of a gas mixture comprising hydrogen. Such a switching gas provides an efficient cooling of the arc. An arc voltage may be increased by increasing the length of the arc. Advantageously, the switching device comprises a switching compartment that is gas tight. Thus, an unwanted exit of hot switching gases is prevented.

Alternatively, the switching device is realized as an air switch or air breaker switch. The switching gas may be air. The arc voltage may be increased by separating the arc into several parts in an arcing chamber or switching chamber.

FIG. 1A shows an example of a switching device 10. The switching device 10 realizes a circuit breaker function and a drive function. In the following the breaker function is explained. The switching device 10 comprises a first and a second fixed contact 12, 13, a first and a second movable contact 14, 15 and a contact bridge 16. The contact bridge 16 may be named switching bridge. The first and the second movable contact 14, 15 are fixed on the contact bridge 16. The second fixed contact 13 and the second movable contact 15 are not shown in FIG. 1A; they are covered behind other parts of the switching device 10 in this three-dimensional view. The contact bridge 16 directly connects the first movable contact 14 to the second movable contact 15.

Figure 4:
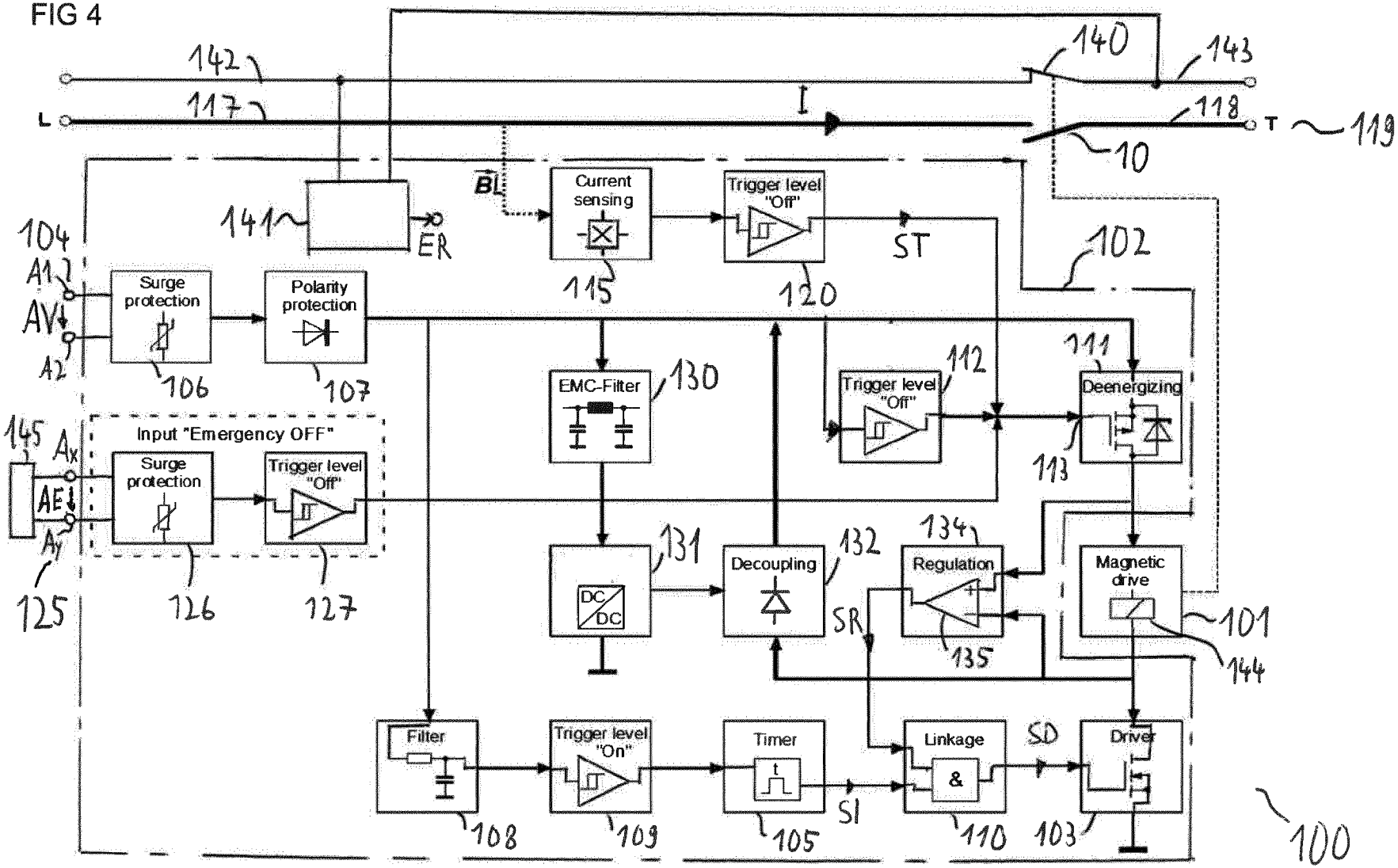
FIG. 4 shows an example of a switching arrangement with a control circuit.

Moreover, the switching device 10 comprises a first and a second terminal contact 17, 18. The first and the second terminal contact 17, 18 may be named first and second stationary contact piece, fixed contact piece or terminal contact piece. The first fixed contact 12 is directly fixed on the first terminal contact 17. The second fixed contact 13 is directly fixed on the second terminal contact 18. The first and the second terminal contact 17, 18 each have a terminal connection hole 19, 20. An end of the first terminal contact 17 having the terminal connection hole 19 is designed for contacting a first terminal lead that is connected from the outside to the switching device 10. A terminal lead can be realized as busbar or power cable. An end of the second terminal contact 18 having the terminal connection hole 20 is designed for contacting a second terminal lead that is connected from the outside to the switching device 10 (such as shown in FIG. 4). The terminal connection hole 19 of the first terminal contact 17 may be on an opposite side of the switching device 10 in comparison to the terminal connection hole 20 of the second terminal contact 18. The two terminal connection holes 19, 20 are configured for fixation of the two terminal leads, e.g. via bolts, pins or studs inserted into the terminal connection holes 19, 20.

The switching device 10 comprises a first pair of arc extinguishing devices 21, 22. The first pair of arc extinguishing devices 21, 22 is attached to the first terminal contact 17. Correspondingly, the switching device 10 comprises a second pair of arc extinguishing devices 23, 24. The second pair of arc extinguishing devices 23, 24 is fixed on the second terminal contact 18. Only one arc extinguishing device 24 of the second pair can be seen in FIG. 1A.

Additionally, the switching device 10 comprises a first pair of arc runners 25, 26 that is fixed at the contact bridge 16. The first pair of arc runners 25, 26 is attached to the contact bridge 16 in vicinity of the first movable contact 14. Correspondingly, the switching device 10 comprises a second pair of arc runners 27, 28. The second pair of arc runners 27, 28 is fixed to the contact bridge 16 in vicinity of the second movable contact 15. In FIG. 1A only one arc runner 28 of the second pair of arc runners can be seen. Each of the arc extinguishing devices 21 to 24 comprises a number of splitter plates 30 that are arranged in a holder 31. The holder 31 holds the splitter plates 30 and is connected to the first or the second terminal contact 17, 18.

Additionally, the switching device 10 comprises a permanent magnet system 35 that comprises a permanent magnet 36. The permanent magnet 36 is realized as a rectangular cuboid. Thus, the six faces of the permanent magnet 36 are rectangles. The permanent magnet 36 may be realized using a ferromagnetic material, a ferrite or a rare earth magnetic material. Moreover, the permanent magnet system 35 comprises an inner pole plate 37 and an outer pole plate 38. The inner and the outer pole plates 37, 38 have a U-shape form. The permanent magnet 36 is arranged between the inner pole plate 37 and the outer pole plate 38. Thus, the inner pole plate 37 may be a south pole plate and the outer pole plate 38 may be realized as a north pole plate. The outer pole plate 38 has the form of a rectangle before the outer pole plate 38 is bended in the U-shape. Correspondingly, the inner pole plate 37 has the form of a rectangular sheet before it is bended to realize the U-shape. The inner and the outer pole plates 37, 38 have openings. For example, the inner pole plate 37 has openings to allow a placement and a movement of the contact bridge 16. The permanent magnet system 35 is further explained using Figures IB to IE and 2. The switching device 10 comprises a contact spring 91 that contacts the center of mass of the contact bridge 16.

The switching device 10 is configured to be set in a switched-on state or a switched-off state. The switched-off state is shown in FIG. 1A. In the switched-off state, the first fixed contact 12 is not in contact with the first movable contact 14. Correspondingly, the second fixed contact 13 is not in contact with the second movable contact 15. Thus, a flow of a load current I from the first terminal contact 17 to the second terminal contact 18 via the contact bridge 16 is inhibited.

The switching device 10 is set from the switched-off state into the switched-on state by a movement of the contact bridge 16 in a direction perpendicular to the contact bridge 16. A magnetic drive 101, as shown in FIG. 4, moves the contact bridge 16 towards the first and the second terminal contact 17, 18. In the switched-on state, the first fixed contact 12 is in contact to the first movable contact 14 and the second fixed contact 13 is in contact to the second movable contact 15. Thus, a load current I can flow from the first terminal contact 17 via the first fixed contact 12, the first movable contact 14, the contact bridge 16, the second movable contact 15 and the second fixed contact 13 to the second terminal contact 18. The load current 1 that flows through the contact bridge 16 has a curved path. As shown in FIG. 1A, the contact bridge 16 has as an S-shaped form or a meander form.

The switching device 10 is set from the switched-on state into the switched-off state by a movement of the contact bridge 16 that separates the contact bridge 16 from the first and the second terminal contacts 17, 18. In case of a load current I flowing before switching, a first arc is generated between the first fixed contact 12 and the first movable contact 14 and a second arc is generated between the second movable contact 15 and the second fixed contact 13. The first arc is driven in one of the arc extinguishing devices 21, 22 of the first pair of arc extinguishing devices depending on the direction of the load current I. Correspondingly, the second arc is driven in one of the arc extinguishing devices 23, 24 of the second pair of arc extinguishing devices depending on the direction of the load current I.

The movement of the first arc into one of the arc extinguishing devices 21, 22 is caused by a magnetic field at the place of the first arc. The magnetic field is generated by the permanent magnet system 35 and by different sections of the path of the load current I, for example the flow of the load current I in a first outer part 51 of the contact bridge 16 that is connected to the first movable contact 14 and by the load current I flowing through the first terminal contact 17. The second arc is moved in a corresponding manner.

The arcs that are generated when opening the contacts 12 to 15 are quickly moved away and are extinguished to safely control a high short-circuit current. In the case of a short circuit, the arcs are moved away by the form of the contact bridge 16 that realizes a so-called magnetic field loop or magnetic blowout field loop. A field loop increases the magnetic field generated by the load current I itself. Thus, in the case of a short circuit, during the procedure of opening the contacts 12 to 15 a strong force moves the arcs away from the contacts 12 to 15 in the direction of the arc extinguishing devices 21 to 24. In the case of a short circuit, this dynamic Lorentz force is higher than the force generated by the permanent magnet system 35. The permanent magnet system 35 is realized as a permanent magnetic field arrangement and is used for driving of arcs with a load current 1 being the nominal current or less. The direction of the Lorentz force is determined by the direction of the load current I. In case the direction of the load current I is reversed, the direction of the magnetic field of the blowout field loop is reversed. Thus, the dynamic Lorentz force also has the effect that the force is directed into the same direction independent from the current direction such that an arc generated at a contact pair is always moved into the same arc extinguishing device in the case of a short circuit.

A current sensing unit 115, for example, comprising a Hall sensor, detects the increase of a magnetic field when a short circuit is starting. This current sensing unit 115 may be arranged in close vicinity of the first or second terminal contact 17, 18. The current sensing unit 115 will be further explained by FIG. 4.

Figure IB shows a top view of the example of the contact bridge 16 shown in FIG. 1A. The contact bridge 16 comprises a first and a second outer part 51, 52 and a central part 53 that are oriented in the same direction. Moreover, the contact bridge 16 comprises a first and a second intermediate part 54, 55. The first movable contact 14 is arranged at one end of the first outer part 51. A second end of the first outer part 51 is connected via the first intermediate part 54 to a first end of the central part 53. The second end of the central part 53 is coupled via the second intermediate part 55 to a first end of the second outer part 52. The second movable contact 15 is connected to a second end of the second outer part 52. Thus, in the top view, the contact bridge 16 has the form of a meander or the form of an S. The load current I has an S-shaped path or a meander-shaped path. The first pair of arc runners 25, 26 is connected to the first outer part 51. The second pair of arc runners 28, 29 is connected to the second outer part 52. Two sections of the inner pole plate 37 are inside the slits of the contact bridge 16.

Figure 3:
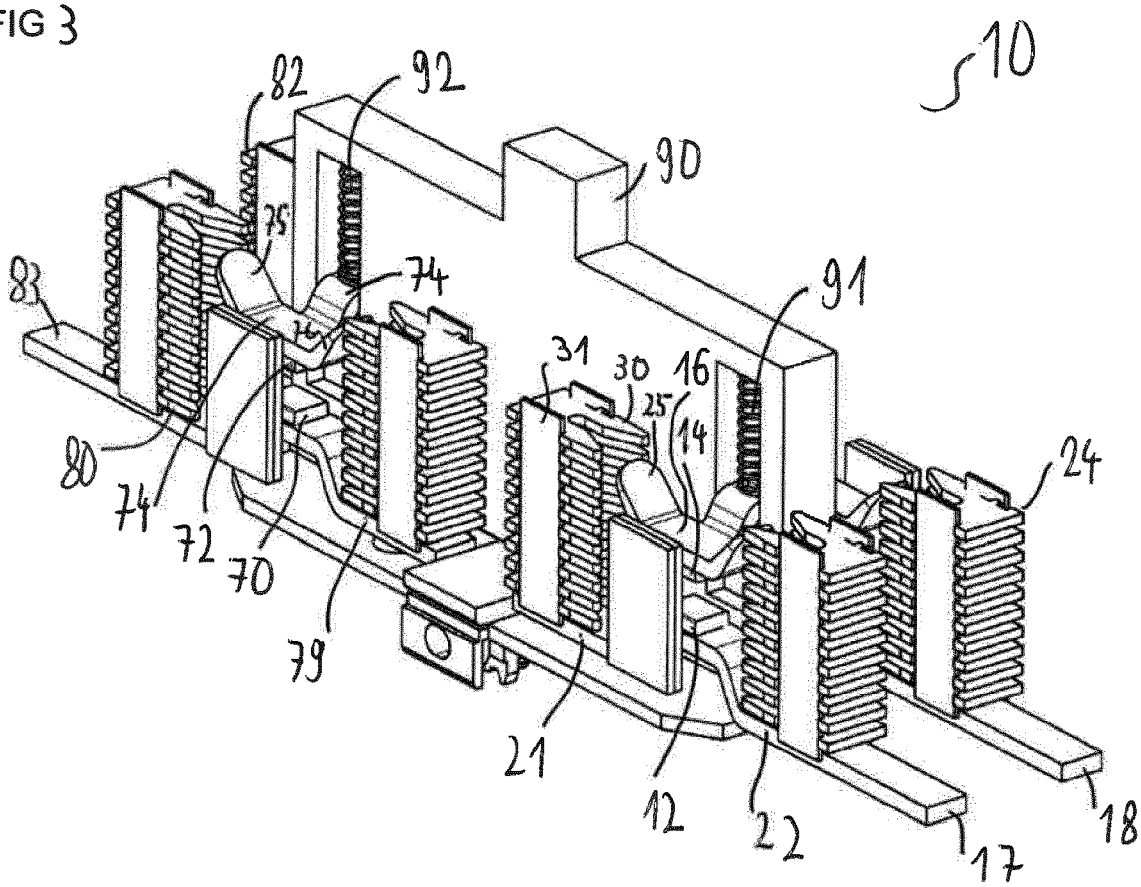
FIG. 3 shows a further example of a switching device.

The compact switching device 10 may be used for bidirectional higher currents such as in the automotive field. A contact bridge 16 may be oriented in the direction of the terminal contacts 17, 18. However as shown in FIGS. 1A to IE and 3, the contact bridge 16 has a main direction that is across, e.g. perpendicular to, the main direction of the first and second terminal contact 17, 18. The perpendicular arrangement of the contact bridge 16 and of the first and second terminal contacts 17, 18 may have the effect that in the case of a short circuit the magnet forces generated from the terminal contacts 17, 18 and from the contact bridge 16 are directed in different directions. An additional magnetic force component is formed by the magnetic field of the permanent magnet system 35. This magnetic field has a direction across or perpendicular to the terminal contacts 17, 18. The resulting Lorentz force that moves the arc has an effect not exactly in the longitudinal direction of the terminal contacts 17, 18, but has an angle to this longitudinal direction depending on the level of the short-circuit current I. An optimum movement and extinguishing of the arcs and thus a quick switching-off may be hindered in the case of a short circuit contrary to the situation at the switching-off of a DC nominal current. This may be valid for a pure perpendicular arrangement as shown in FIG. 3. However, the contact bridge 16 with the S-form or a similar form realizes a blowout field that is larger than the field generated by the permanent magnet system 35.

The contact bridge 16 has an S-shape. The movement of the arcs is improved by the S-shape of the contact bridge 16. The first arc between the first fixed contact 12 and the first movable contact 14, the first terminal contact 17, and the first outer part 51 of the contact bridge 16 (such as shown in Figure IB) forms a first magnetic field loop, also called first magnetic blowout field loop. Moreover, the second arc between the second fixed contact 13 and the second movable contact 15, the second terminal contact 18 and the second outer part 52 of the contact bridge 16 (such as shown in Figure IB) forms a second magnetic field loop. The first and the second magnetic field loops are coupled together. These two arcs are generated in the case of opening the contacts 12 to 15 under load.

In the case of a short circuit, the first magnetic field loop has a magnetic blow effect on the first arc in the direction of one arc extinguishing device of the first pair of arc extinguishing devices 21, 22. Correspondingly, the second magnetic field loop has a blowout effect on the second arc in the direction of an arc extinguishing device of the second pair of arc extinguishing devices 23, 24. This blow effect is only slightly deflected by the part of the dynamic Lorentz force which results from the inner parts 53 to 55 of the contact bridge 16. In the case of an S-shaped contact bridge 16, the deflection is less than in the case of conventional contact bridges having a simple geometry, e.g. a rectangular form. The yield of the force which has an effect in the direction of the arc extinguishing devices 21 to 24 is increased.

The two arcs are always driven into the same arc extinguishing devices independently of the direction of the load current I in the case of a short-circuit. In the case of the switching device 10 shown in FIG. 1A, the first arc is driven into the arc extinguishing device 22 at the right side of the first terminal contact 17. Moreover, the second arc is driven into the arc extinguishing device 23 at the left end of the second terminal contact 18. Thus, the first arc is always driven into the same arc extinguishing device and the second arc is always driven into another arc extinguishing device. The arrangement of the contact bridge 16 and of the first and second terminal contact 17, 18 realizes an effective current loop which—in combination with the permanent magnet system 35—results in a quick blowout of the arcs in the case of a bidirectional switching of a DC nominal current as well as in the case of a short circuit.

Figure 1C:
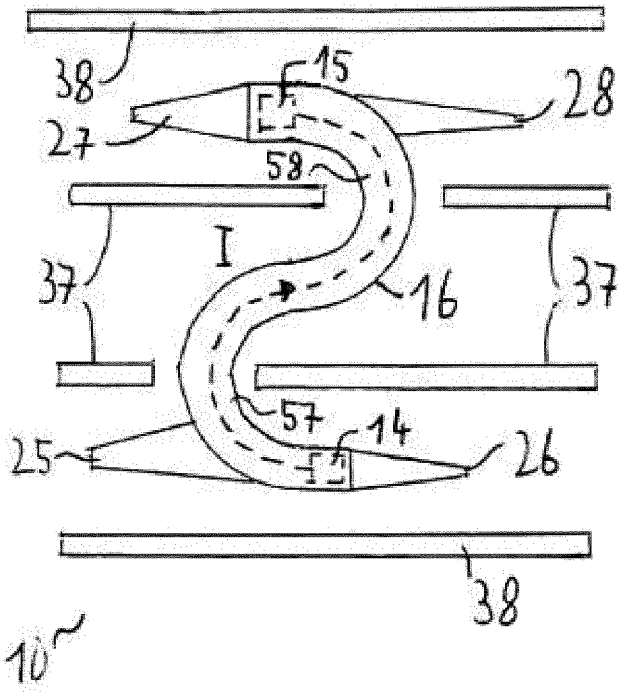
Figure 1B:
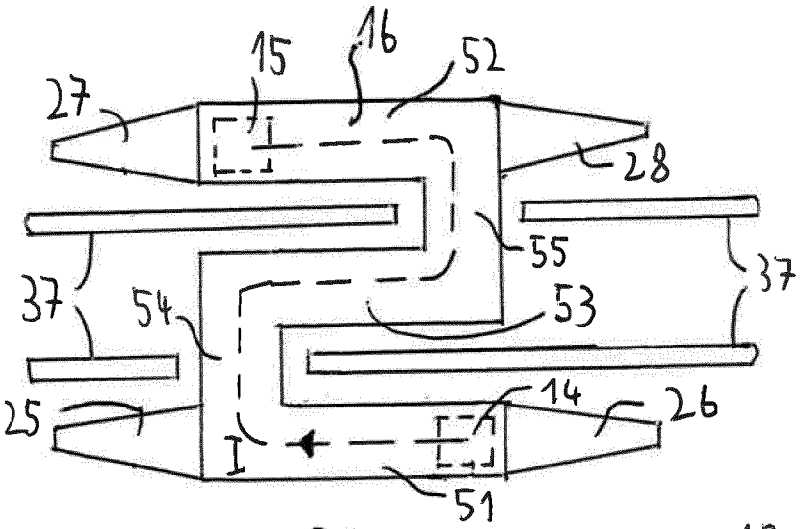
Figure 1D:
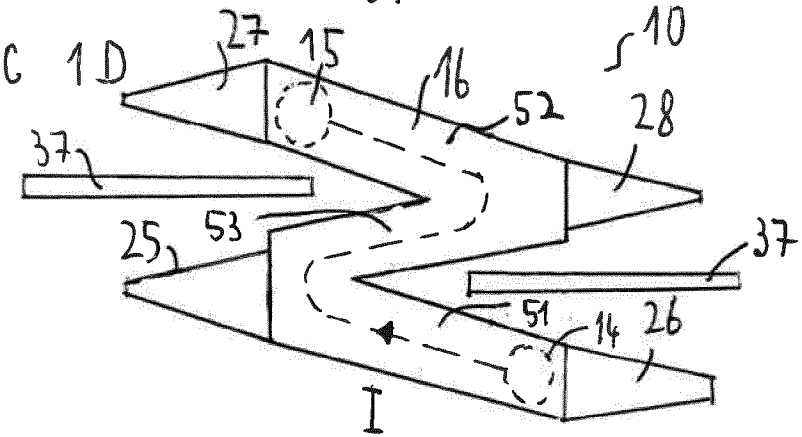

FIG. 1C shows an alternative example of the contact bridge 16 in a top view which is a further development of the examples shown in FIGS. 1A and 1B. The contact bridge 16 comprises a first and a second semicircle 57, 58. At a first end of the first semicircle 57, the first movable contact 14 is arranged. A second end of the first semicircle 57 is connected to a first end of the second semicircle 58. At a second end of the second semicircle 58, the second movable contact 15 is fixed. The first movable contact 14 is between the inner pole plate 37 and the outer pole plate 38. Also the second movable contact 15 is between the inner pole plate 37 and the outer pole plate 38. The load current I has an S-shaped path, a path comprising two connected semicircles and/or a path twice curved in opposite directions. Alternatively, the contact bridge 16 may comprise a rectangular part between the first and the second semicircle 57, 58 or at the ends of the first and the second semicircle 57, 58.

Figure 2:
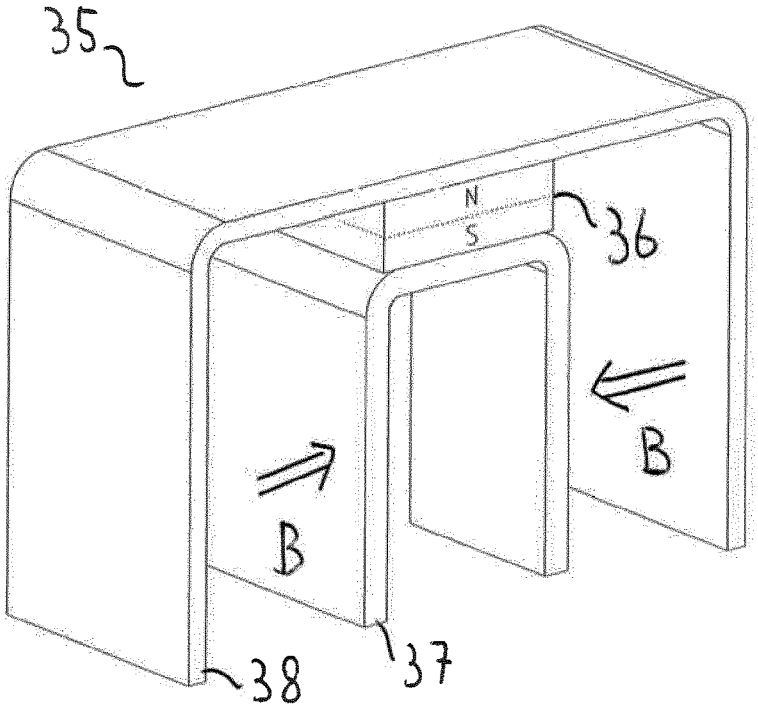
FIG. 2 shows an example of a permanent magnet system.

Figure ID shows an alternative example of the contact bridge 16 in a top view which is a further development of the examples shown in FIGS. 1A to 1C. The contact bridge 16 comprises the first and the second outer part 51, 52 and the central part 53 that are arranged in a zig-zag form or a Z-shape. The load current 1 has a zig-zag path or Z-shaped path. The movable contacts 14, 15 are indicated as dashed lines, since Figures IB to ID show the contact bridge 16 in top view. The outer pole plate 38 is not shown in Figures IB and ID, but is arranged such as shown in FIGS. 1A, 1C and 2.

Figure IE shows an alternative example of the contact bridge 16 which is a further development of the examples shown in FIGS. 1A to ID. The contact bridge 16 comprises the first and the second outer part 51, 52 and the central part 53. The central part 53 connects the first outer part 51 to the second outer part 52. A main direction of the first outer part 51 is parallel to a main direction of the second outer part 52. The main direction of the first outer part 51 may be across to a main direction of the central part 53. The main direction of the first outer part 51 may be perpendicular to the main direction of the central part 53. For example, the main direction of the first outer part 51 is perpendicular to the main direction of the central part 53. The first and the second outer part 51, 52 and the central part 53 are arranged in a zig-zag form or Z-form. The first outer part 51 and the central part 53 are arranged in an L-form or hook-form. The second outer part 52 and the central part 53 are also arranged in an L-form or hook-form.

The first movable contact 14 is not located at the connection of the first outer part 51 to the central part 53. The first movable contact 14 is not located in the main direction of the central part 53. A center of the first movable contact 14 has a distance D to a center axis or mirror axis of the central part 53. Correspondingly, the second first movable contact 15 is not located at the connection of the second outer part 52 to the central part 53. The second movable contact 15 is not located in the main direction of the central part 53. A center of the second movable contact 15 has a distance D' to a center axis or mirror axis of the central part 53. The distance D' may be equal to the distance D.

The path of the load current I has a U-form or U-shape. The load current I flowing from the first terminal contact 17 via the first fixed contact 12, the first arc and the first movable contact 14 to the first outer part 51 has the U-form. The U-form of the load current I is obtained in a side view on the switching device 10. Similarly, the load current I flowing from the second outer part 52 via the second movable contact 15, the second arc and the second fixed contact 13 to the second terminal contact 18 has a U-form. Thus, the load current 1 obtains a further U-form. The load current 1 flowing in other types of the switching bridge 10 such as shown in FIGS. 1A to ID also obtains the U-form and the further U-form in the side view. In Figure IE, the U-form and the further U-form are indicated by dashed lines.

In a top view on the contact bridge 16, the load current I has an S-shaped path, zig-zag path or Z-shaped path.

The contact bridge 16 comprises a hook-form or two hook-forms. The first and the second outer part 51, 52 are elongated. The first movable contact 14 is on the elongated portion of the first outer part 51. The second movable contact 15 is on the elongated portion of the second outer part 52. The first and the second outer part 51, 52 may be orthogonal to the first and the second contact terminal 17, 18.

As shown in FIGS. 1A to IE, the contact bridge 16 comprises a metal. The contact bridge 16 may be fabricated from a metal. The contact bridge 16 may only consist of metal.

In an alternative embodiment, the contact bridge 16 comprises a metal part formed such as shown in FIGS. 1A to IE and one or more than one isolating parts attached to the sides of the metal parts.

The described example shapes of the contact bridge 16 are non-limiting examples, and the terms "S-shape," "zig-zag," "meander," "Z-shape," "two connected semicircles", and "opposite directions" should be understood broadly. In certain embodiments, an example contact bridge 16 forms a first progression path (e.g., one side of the S-shape or other selected shape) in the region of the first moveable contact 14. In certain embodiments, the example contact bridge 16 further forms a second progression path (e.g., the other side of the S-shape or other selected shape) in the region of the second moveable contact 15. The first and second progression paths support the capability to provide a selected geometric arrangement of the fourth and fifth progression paths described following. It can be seen that the shapes of the first progression path and the second progression path may be the same or distinct from each other.

The example contact bridge 16 further forms a third progression electrically coupling the first progression portion to the second progression portion. The third progression may additionally engage the contact spring 91 or other actuating device.

Figure 1E:
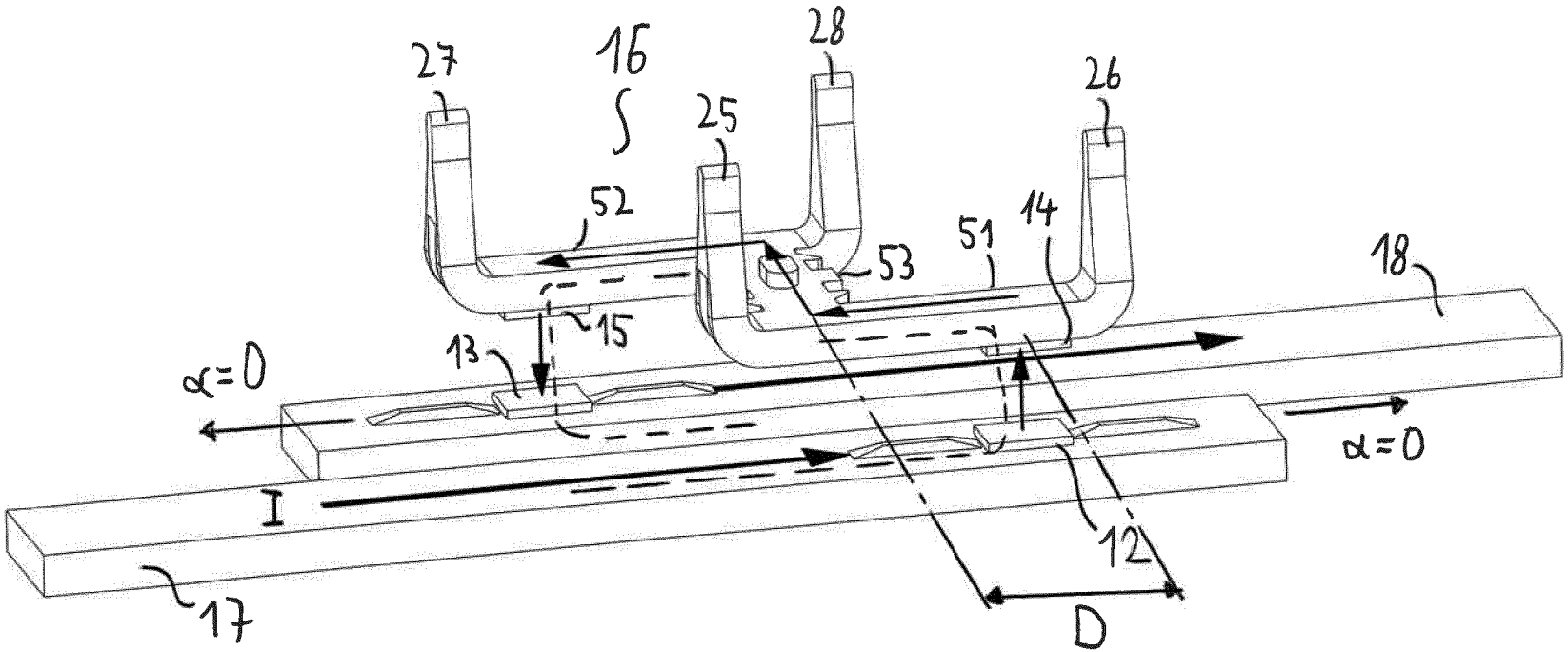

The example contact bridge 16 further forms a portion of a fourth progression in the region of the first fixed contact 12, where the fourth progression additionally or alternatively includes a portion of the first terminal contact 17. In the example of FIG. 1E, the fourth progression is represented in the U-form current flow through the first fixed contact 12. The contact bridge 16 further forms a portion of a fifth progression in the region of the second fixed contact 13, where the fifth progression additionally or alternatively includes a portion of the second terminal contact 18. In the example of FIG. 1E, the fifth progression is represented in the U-form current flow through the second fixed contact 13. The fourth and fifth progressions of the contact bridge 16 support dynamic blowout operation to the arc extinguishing devices (e.g., 21, 24) under designed operating conditions (e.g. at a short circuit current or a designed dynamic blowout current).

The example contact bridge 16 is described as forming a first progression, a second progression, a third progression, and at least portions of a fourth and fifth progression, to schematically depict the logical elements of an example contact bridge 16. However, in certain embodiments, the physical elements of the contact bridge 16 forming the various progressions may be shared and/or combined. For example, referencing FIG. 1C, the portion of the contact bridge 16 forming the third progression may not be a physically distinct portion of the contact bridge 16 from the first and/or second progressions. In certain embodiments, one or more of the first through fifth progressions may be omitted or combined. For example, referencing FIG. 1E, the first and second progressions are omitted due to an offset of the first fixed contact 12 and the second fixed contact 13, whereby the fourth and fifth progressions can be formed without a distinct physical element of the contact bridge 16 forming the first and second progression. In another example, referencing FIG. 3, only the third progression is depicted as forming a physical element of the contact bridge 16.

One of skill in the art, having the benefit of the present disclosure and information ordinarily available when contemplating a particular embodiment of a switching device 10, can readily determine which of the first through fifth progressions to embody in the switching device 10, and which physical elements, including the arrangement of such physical elements, of the contact bridge 16 and/or terminal contacts 17, 18 to utilize to form the included ones of the first through fifth progressions. Certain considerations for determining which of the first through fifth progressions to include and the physical arrangements of the contact bridge 16 and/or terminal contacts 17, 18 include, without limitation: the designed nominal operating current value (s) of the switching device 10, the designed dynamic blowout or short circuit opening current of the switching device 10, the strength and arrangement of the permanent magnet system 35, the dynamic response of current expected in the system during a dynamic blowout or short circuit, the requirements for protection for a system including the switching device (e.g., opening time, arc extinguishment time, etc.), the arrangement of the arc extinguishing devices (e.g., position, distance), any geometric arrangement constraints (e.g., the size and/or shape of the switching device 10 and/or a housing therefore), the contact closing force(s) provided by the contact spring(s) 91 and/or other actuating device, the availability and response time of current detection and active current response (e.g., the capability and timing of the contact spring(s) 91 and/or other actuating device to begin opening during a high current event), and/or the moveable mass of the contact bridge 16 and/or actuating system for the contact bridge 16.

FIG. 2 shows an example of the permanent magnet system 35 which is a further development of the examples shown in FIGS. 1A to IE. The permanent magnet system 35 may be realized independent of the dynamic blowout field arrangement and may be configured for different load currents 1. In certain embodiments, the permanent magnet system 35 provides for arc movement at nominal load operations, for example where the arc movement support from the fourth and/or fifth progressions is not significant, thereby reducing damage and wear to the contacts over operating cycles. The inner pole plate 37 and the outer pole plate 38 are both formed in a U-shape. A magnetic field B generated by the permanent magnet system 35 is perpendicular to the inner pole plate 37 and to the outer pole plate 38.

The load current I that flows through the first terminal contact 17 generates an additional magnetic field. Also the load current I that flows through the contact bridge 16—for example through the first outer part 51—generates a further magnetic field. The magnetic fields generated by the load current I and by the permanent magnet system 35 are added at the place where the first arc appears during operations of the switching device 10. Thus, the magnetic field B generated by the permanent magnet system 35 is superposed by the (dynamic) magnetic field, generated by the load current I. Therefore, a blowout of the first arc is improved in case of high currents. Correspondingly, a blowout of the second arc between the second fixed contact 13 and the second movable contact 15 is improved.

FIG. 3 shows an alternative example of a switching device 10. The switching device 10 is configured as a two-pole polarity-independent switching device for DC currents. Here the contact bridge 16 is realized as a rectangular cuboid. The contact bridge 16 is not realized as an S-shape, Z-shape, zig-zag, meander or part comprising two semicircles.

For the realization of a second pole, the switching device 10 comprises a further first and second fixed contact 70, 71, a further first and second movable contact 72, 73, a further contact bridge 74, a further first pair of arc runners 75, 76, a further second pair of arc runners 77, 78, a further first pair of arc extinguishing devices 79, 80, a further second pair of arc extinguishing devices 81, 82 and a further first and second terminal contact 83, 84. Some of the parts are not shown in this three-dimensional view on the switching device 10. The first pole is realized such as the second pole. The two poles of the switching device 10 are symmetrically implemented.

The switching device 10 comprises a contact bridge carrier 90. The contact bridge carrier 90 is coupled to the contact bridge 16 via a contact spring 91. The contact spring 91 is arranged between the contact bridge carrier 90 and the center of mass of the contact bridge 16. Correspondingly, the contact bridge carrier 90 is coupled to the further contact bridge 16 via a further contact spring 92. The contact bridge carrier 90 is movable and may be made of plastics. The switching device 10 comprises an armature. The armature is coupled to the contact bridge carrier 90. The armature is fixed to the contact bridge carrier 90. The magnetic drive 101 as shown in FIG. 4 provides a movement to the armature. Therefore, the magnetic drive 101 provides a movement via the armature, the contact bridge carrier 90 and the contact spring 91 to the contact bridge 16. Thus, the contact bridge 16 and the further contact bridge 74 operate in parallel.

The switching device 10 can be used for conducting and switching of high DC nominal currents independent from polarization, for example for the operation of an electro vehicle. The switching device 10 may be optionally modified to inhibit a welding and thus a dropout of the switching device 10 in the case of a short circuit or a non-successful extinguishing or a re-ignition of a short-circuit high-energy arc. As a modification, the switching device 10 is also configured for the safe switching-off of the load current I in a safety-relevant incident. An early automatic switch-off of the electromechanical drive by the switching device 10 inhibits an automatic closure of the contacts 12 to 15 that are interrupted in the case of a short circuit by the dynamic forces of the load current I.

For realization of the contact module, the switching device 10 or a switching arrangement 100, a magnetic contactor can be arranged, improved relative to previously known magnetic contactors, and/or optimized, such that a very high contact force is generated in the closed state in reference to a conventional switching device by an efficient magnetic flux (e.g., with reduced eddy currents) through the magnet core and the armature and a reduction of the movable mass. A contact force which is "very high" includes any contact force sufficient to prevent dynamic opening of the contacts below a designed current value. An example further includes the designed current value being set at a short circuit current or other value to prevent catastrophic damage. In another example, a contact force which is "very high" includes a contact force high enough such that, in a previously known system, the contact force would dynamically re-engage the contacts after a dynamic opening commenced, but due to one or more features of the present disclosure (e.g., designed contact opening velocity, moveable mass selection, and/or active current sensing and actuator operation) nevertheless the contacts are prevented from re-engaging after the dynamic opening. The high contact force has the effect that the contacts 12 to 15 are kept closed up to the point at which the load current 1 reaches a short-circuit threshold. Thus, an early dynamic lift-off or contact opening is avoided. In certain embodiments, the high contact force provides for support for greater current loads for the switching device 10 than previously known, providing for, without limitation, multiple power ratings of a system utilizing the switching device 10 (e.g., making the switching device 10 readily integratable into various systems), high current operations such as quick charging operations, prevention of nuisance opening events for highly transient currents and/or operation above a nominal current value but less than a catastrophic damage value, and/or operation of the switching device 10 into high current regions that close the gap between a protective fuse current value and/or the dynamic opening current value. Previously known systems having a lower contact force result in various design constraints, such as acceptance of nuisance openings, protection gaps between a fuse engagement current and the supported current from the switching device, and/or multiple switching device configurations that have to be designed for system having varying current load values.

The prevention of the early dynamic lift-off or contact opening provides for avoiding a realization of a high-energy arc caused by a too low contact force in the case of a short circuit. Such a case has the risk that the switching contacts 12 to 15 are closed again after a short time, caused by a magnetic drive 101 (shown in FIG. 4) being still closed at this point of time and/or by a low opening velocity of the contacts during the dynamic lift-off. Thus, a welding of the surfaces of the reclosed contacts 12 to 15 occurs, since the surfaces of the contacts 12 to 15 are already melted by the high-energy arcs. For the electrodynamic lift-off procedure, an early closing of the contacts 12 to 15 can be avoided by a tuning of the mass of the movable system (comprising the contact bridge 16, the bridge carrier 90 and the armature) and of the velocity of opening the electromagnetic drive to inhibit a welding of the contacts 12 to 15. In certain embodiments, certain additional features of the present disclosure further prevent an early closing of the contacts 12 to 15, for example and without limitation the current threshold for opening (e.g., the designed current value at which dynamic lift-off commences), command time for the electromagnetic drive (e.g., active opening current threshold values, response time of current detection, and command delays) and response time of the electromagnetic drive to a command instructing an opening of the contacts before and/or during the dynamic lift-off.

FIG. 4 shows an example of a switching arrangement 100. The switching arrangement 100 may be named switching apparatus. The switching arrangement 100 comprises the switching device 10 indicated by the symbol of switch. The switching device 10 is a mechanical switching device. The switching device 10 may be realized as shown in FIGS. 1A to IE and 2 or in FIG. 3 or as one pole of the switching device 10 depicted in FIG. 3 or in another way. Moreover, the switching arrangement 100 comprises a magnetic drive 101 that generates a movement of the armature and of the contact bridge carrier 90 shown in FIG. 3 and of an armature and of a contact bridge carrier of the switching device 10 as shown in FIGS. 1A to IE and 2. The switching device 10 is realized as a normally open device (NO device). Thus, in the case that no current flows through the magnetic drive 101, no magnetic field is generated by the magnetic drive 101 and the switching device 10 is set in the switched-off state. A current flowing through the magnetic drive 101 generates a magnetic field and thus a movement of the armature that sets the switching device 10 in a switched-on state.

The switching arrangement 100 comprises a control circuit 102 that is coupled to the magnetic drive 101. The control circuit 102 controls the magnetic drive 101. A driver 103 of the control circuit 102 is coupled to the magnetic drive 101. The control circuit 102 comprises a control input 104 that is coupled to the driver 103. The control input 104 comprises two control terminals A1, A2. A path between the control input 104 and the driver 103 comprises a timer 105. A control signal AV is provided to the control input 104. The control signal AV may have the form of a voltage. The control signal AV may be realized as a magnetic coil voltage. The magnetic coil voltage can be tapped between the two control terminals A1, A2. Additionally or alternatively, the control input 104 may be a command or communication (e.g., from a network on the system), a virtual signal (e.g., a calculated voltage, state, or other parameter utilized as the control input 104), or another physical connection such as an electrical signal of any type. In certain embodiments, either the presence of a signal, the absence of a signal, or a value of the signal may be utilized as a control input 104. When the control signal AV indicates a command that the switching device 10 has to be set in a switched-on state, the control signal AV is provided to the driver 103 via the timer 105. The timer 105 provides a predetermined turn-on time. An output signal SI at an output of the timer 105 is triggered by the control signal AV or a signal derived from the control signal AV and is provided during the predetermined turn-on time. The timer 105 temporarily limits the inrush current (which may be high); after that only the sealing current flows through the magnetic drive 101 (which may be significantly lower than the inrush current), as explained below. The inrush current is limited in its level and in its duration. Thus, current peaks are avoided. The duration is limited to achieve a transition from the inrush current to the lower sealing current, resulting in power saving.

In certain embodiments, the predetermined turn-on time is adjusted over the life of the switching arrangement 100 and/or a system incorporating the switching arrangement 100. For example, the inrush current values may be sensed during operations of the switching arrangement 100 and the predetermined turn-on time is adjusted accordingly, allowing response to part-to-part variations in the system (e.g., various capacitive elements of the system and/or a resistor on the inrush circuit), variations in the system that occur over the operating life of the system (e.g., due to wear or degradation, and/or variances in the electrical arrangement of the system at startup), and/or allowing for the predetermined turn on time to respond to multiple system configurations without full knowledge of the system configuration at design time of the switching arrangement 100 (e.g., allowing the switching arrangement 100 to readily support multiple system types, applications, or arrangements). In certain embodiments, the predetermined turn-on time is adjusted according to current peaks observed, which may include at least a current threshold value, a current time spent over a threshold value and/or an area of the current in the time domain relative to a threshold value, and/or any of these during the transition from the inrush circuit operation to the switched-on state of the switching device 10.

The control input 104 is coupled via a surge protection unit 106, a polarity protection unit 107, a filter 108 and a first trigger level detector 109 to the timer 105. The polarity protection unit 107 provides safety against a reversed polarity of the control signal AV. The timer 105 is coupled via a control unit 110 to an input of the driver 103. The first trigger level detector 109 detects whether a signal at the input of the first trigger level detector 109 is in a predetermined voltage range, wherein the predetermined voltage range indicates that the switching device 10 is to be set in the switched-on state. The trigger level detector 109 may be implemented as a comparator. The timer 105 is only triggered by the trigger level detector 109, if the control signal AV or the signal derived from the control signal AV is over a predetermined value. The predetermined value is set such that a safe transition between a switched-off state and a switched-on state can be performed. The filter 108 is implemented as low-pass filter. The trigger level detector 109 may be implemented as a Schmitt trigger circuit. Thus, the trigger level detector 109 may use a hysteresis. Therefore, a flutter of the magnetic drive 101 is avoided.

Moreover, the control circuit 102 comprises a de-energizing unit 111 that is coupled to the magnetic drive 101. The de-energizing unit 111 is configured to provide a current to the magnetic drive 101 that quickly sets the armature of the switching device 10 in the switched-off position. Thus, the switching device 10 can be actively set in the switched-off state by the de-energizing unit 111. The control input 104 is coupled via the surge protection unit 106 and the polarity protection unit 107 to an input of the de-energizing unit 111 which may be a supply input. Moreover, the control input 104 is coupled via the surge protection unit 106, the polarity protection unit 107 and a further trigger level detector 112 to a control input 113 of the de-energizing unit 111.

The further trigger level detector 112 determines whether the signal at the input of the further trigger level detector 112 is in a further predetermined range indicating that the switching device 10 is to be set in the switched-off state. The further trigger level detector 112 may be realized as a comparator and/or Schmitt trigger circuit. A further predetermined value for switching-off may be e.g. 35% of the nominal value. The further trigger level detector 112 is configured not to react on short voltage drops, e.g. having a duration of a half of the mains period or less. If the further trigger level detector 112 detects that the control signal AV or a signal derived from the control signal AV is lower than the further predetermined value, the de-energization unit 111 is activated and the magnetic drive 101 is de-energized via a defined freewheeling voltage. Thus, a duration of the transition from the switched-on state to the switched-off state of the switching device 10 is constant. The duration may be independent from a present level of the control signal AV or a supply voltage and external circuits connected to the switching arrangement 100.

The driver 103 and the de-energizing unit 111 each comprise a transistor to control a current flowing through a magnetic drive coil 144 of the magnetic drive 101. The magnetic drive 101 also includes a magnet core. A current flowing through the magnetic drive coil 144 energizes the magnetic drive coil 144 such that the armature is pulled into the magnet core in order to close the magnetic flux circuit.

Thus, the control signal AV at the control input 104 is configured to determine the current flowing through the magnetic drive 101. The control circuit 102 monitors whether the present level of the control signal AV should trigger switching-on or switching-off of the magnetic drive 101. Thus, the switching device 10 is either set in a switched-on state or in a switched-off state as a function of the control signal AV.

The control circuit 102 comprises a current sensing unit 115. The current sensing unit 115 detects a value of the load current I flowing through the switching device 10. The current sensing unit 115 detects the value of the load current I flowing through a first or a second terminal lead 117, 118 of a power bus 119. The switching device 10 couples the first terminal lead 117 to the second terminal lead 118. The current sensing unit 115 may comprise at least a Hall sensor. Thus, the current sensing unit 115 detects a magnetic field BL generated by the load current 1 flowing through the power bus 119. The current sensing unit 115 is coupled via a trigger level detector 120 to the control input 113 of the de-energizing unit 111. The trigger level detector 120 detects whether a signal at the input of the trigger level detector 120 is in a predetermined range indicating that the load current I is over a predetermined limit and thus the switching device 10 has to be set in the switched-off state. The predetermined range may be selected depending on operating conditions. In certain embodiments, operating conditions that may be utilized to select the predetermined range include, without limitation, a nominal power or power mode of the system, a request or command from the system indicating the present current limit to be enforced, an operating state of the system (e.g., "high power", "economy", and/or "quick charging"), and/or a diagnostic state or communicated limit of a component in the system (e.g., "failed", "degraded," a current limit, a temperature limit, etc.). The trigger level detector 120 may be realized as a comparator and/or Schmitt trigger circuit. The trigger level detector 120 may be configured to compare the signal at the input of the trigger level detector 120 with more than one predetermined range. The trigger level detector 120 generates a trigger signal ST as a result of the comparison. The predetermined range may be selected by a set signal. A threshold or limit of a predetermined range may correspond for example to a load current I of 100 A, 200 A, 400 A, 1 kA (1,000 Ampere), 1.5 kA, 3 kA, or 6 kA.

The current sensing unit 115 may comprise a Hall sensor element. The Hall sensor element detects a present value of the load current 1 and may optionally be designed for a switching-off procedure in the case of a short-circuit. When the load current I rises above a predetermined threshold which may, for example, correspond to the multiple of the nominal current, the voltage of the magnetic drive coil 144 of the magnetic drive 101 will be switched off by the control circuit 102.

The control circuit 102 has an emergency input 125. The emergency input 125 is coupled via the de-energizing unit 111 to the magnetic drive 101. The emergency input 125 is coupled via a further surge protection unit 126 and an emergency trigger level detector 127 to the control input 113 of the de-energizing unit 111. The emergency trigger level detector 127 determines whether a signal at the input of the emergency trigger level detector 127 is in a predetermined range indicating that the switching device 10 has to be set in the switched-off state. The emergency trigger level detector 127 may be realized as a comparator and/or Schmitt trigger circuit. Thus, an emergency signal AE provided to the emergency input 125 indicates that the switching device 10 has to be set in the switched-off state. The emergency signal AE overrules the control signal AV. Thus, the switching device 10 is set by the emergency signal AE in the switched-off state independent of the value of the control signal AV. The emergency input 125 has two terminals Ax, Ay. The emergency signal AE may have the form of a voltage. The emergency signal AE can be tapped between the two terminals Ax, Ay. Additionally or alternatively, the emergency input 125 may be a command or communication (e.g., from a network on the system), a virtual signal (e.g., a calculated voltage, state, or other parameter utilized as the emergency input 125), or another physical connection such as an electrical signal of any type. In certain embodiments, either the presence of a signal, the absence of a signal, or a value of the signal may be utilized as an emergency input 125.

Additionally or alternatively, the control circuit 102 may be responsive to an auxiliary input in a similar manner to either the control input 120 and/or the emergency input 125. For example, a system including the switching arrangement 100 may provide an auxiliary input utilized to request switched-off or switched-on states for the switching device 10. The auxiliary input, if present, may replace operations of either the control input 120 and/or the emergency input 125, and/or may be incorporated with operations of the control input 120 and/or the emergency input 125. The auxiliary input may be utilized for any operations, such as controlling the switched state of the switching device 10 during service, maintenance, or repair, and/or during operations of the system including the switching arrangement 100.

An electric vehicle may comprise the switching arrangement 100. In the case of a critical operation situation such as, for example, in the case of a crash of the electric vehicle, the control circuit 102 performs an emergency off-function. The emergency signal AE realizes a trigger signal. The emergency signal AE is provided to the emergency input 125, for example in the case that an accelerometer or acceleration sensor 145 of the vehicle registers a crash. A crash or a short-circuit current result in an intermediate switching-off of the coil current and in a quick separation of the movable contacts 14, 15 from the fixed contacts 12, 13 of the switching device 10. Alternatively or additionally, the emergency signal AE may be generated at a maintenance event, an accident indicator, an emergency shutdown command, a vehicle controller request, a device protection request for some device on the vehicle, and/or a calculation that a temperature, voltage value or current value has exceeded a threshold.

Furthermore, the control circuit 102 comprises a filter 130 that couples the polarity protection unit 107 to a DC-to-DC converter 131 of the control circuit 102. The filter 130 is realized as an electro-magnetic compatibility filter, abbreviated EMC filter. The filter 130 reduces disturbances such as radio interferences that may be generated by the DC-to-DC converter 131 e.g. at the control input 104. The DC-to-DC converter 131 is realized as a stepdown converter. The DC-to-DC converter 131 provides a DC voltage at its output. In certain embodiments, the DC voltage is constant, but it is understood that the DC voltage may vary within nominal parameters, due to operating conditions, changes in the system over the life of the system (e.g., due to battery degradation and/or power electronics changes), and/or may be dependent upon the system including the switching arrangement 100. The DC voltage may be lower than the nominal voltage, e.g. 10% of the nominal voltage. A node between the magnetic drive 101 and the driver 103 is coupled via a decoupling unit 132 to a node between the polarity protection unit 107 and the de-energizing unit 111. An output of the DC-to-DC converter 131 is connected to an input of the decoupling unit 132. After the turn-on time provided by the timer 105, the magnetic drive 101 is powered by the DC-to-DC converter 131. The DC voltage is provided to the free-wheeling circuit of the magnetic drive 101. The DC voltage is configured as a holding voltage or sealing voltage. Thus, a high shock resistance is achieved even in case of a decrease of a supply voltage or the control signal AV, e.g. down to the value for switching-off.

Moreover, the control circuit 102 comprises a regulation unit 134 coupled on its input side to terminals of the magnetic drive 101. Thus, a first input of the regulation unit 134 is coupled to a node between the de-energizing unit 111 and the magnetic drive 101 and a second input of the regulation unit 134 is coupled to a node between the magnetic drive 101 and the driver 103. The regulation unit 134 comprises an amplifier 135. The regulation unit 134 may compare the voltage difference at the two inputs with a predetermined value. Thus, the regulation unit 134 may generate an output signal SR with a first logical value in the case that the voltage difference at the two inputs is higher than the predetermined value and may generate the output signal SR with a second logical value if the voltage difference at the two inputs is lower than the predetermined value. The regulation unit 134 is designed to determine a state of the magnetic drive 101. The regulation unit 134 has an output connected to an input of the control unit 110.

The control unit 110 is realized as a signal combiner and may be realized as a control logic. The control unit 110 provides a linkage between the signals SI, SR at the inputs of the control unit 110. Thus, the control unit 110 combines the output signal SR of the regulation unit 134 and the output signal SI of the timer 105, for example by an AND-function.

The regulation unit 134 may generate the output signal SR depending on a comparison of the voltage difference at the two inputs and the predetermined value. The output signal SR may be an analog signal. The control unit 110 provides a driver signal SD to the driver 103. The driver signal SD may obtain different non-zero voltage values. The level of the driver signal SD depends on the value of the output signal SR of the regulation unit 134. The duration of the driver signal SD depends on the output signal SI provided by the timer 105. Thus, the driver 103 only receives the driver signal SD to set the switching device 10 in a switched-on state, when the control signal AV indicates that the switching device 10 should be set in the switched-on state. During the transition from the switched-off state to the switched-on state of the switching device 10, the voltage across the magnetic drive 101 and thus at the coil 144 is hold on a constant predetermined value by a control loop. After the turn-on time provided by the timer 105, the driver 103 is switched off. Advantageously, the dynamic behavior of this transition is constant and independent of the present level of the control signal AV. A time for this transition is constant. The mechanical burden on the magnetic drive 101, a contact bounce and power consumption of the magnetic drive 101 are reduced.

The switching arrangement 100 comprises an auxiliary switch 140. The auxiliary switch 140 is coupled with the switching device 10. The contact bridge 16 of the switching device 10 is mechanically coupled with a movable contact of the auxiliary switch 140. The auxiliary switch 140 may comprise exactly one movable contact. The auxiliary switch 140 may be implemented as auxiliary contacts or replaced by auxiliary contacts.

The auxiliary switch 140 may also comprise a first and a second movable contact. In this case, the contact bridge 16 of the switching device 10 is coupled with the first and the second movable contact of the auxiliary switch 140. Thus, the auxiliary switch 140 may comprise several movable contacts. The auxiliary switch 140 comprises a pin or catch that couples the armature and the contact bridge 16 of the switching device 10 to the at least one movable contact of the auxiliary switch 140. The switching device 10 may be configured as a normally open device (NO device). In this case, the auxiliary switch 140 is configured as a normally closed device (NC device).

The control circuit 102 may comprise a control detector 141 that is connected to the two terminals of the auxiliary switch 140, e.g. by two further current lines 142, 143. The control detector 141 detects whether the auxiliary switch 140 is set in a switched-on state or in a switched-off state. When the control detector 141 detects that the auxiliary switch 140 is in a switched-on state and when the current sensing unit 115 detects that there is a non-zero load current 1 flowing through the switching device 10, then the control circuit 102 or the control detector 141 may generate an error signal ER. When the control detector 141 detects that the auxiliary switch 140 is in a switched-off state and when no current flows through the magnetic drive coil 144, then the control circuit 102 or the control detector 141 may generate the error signal ER. This may be the case, for example when the movable contacts 14, 15 of the switching device 10 cannot be separated from the fixed contacts 12, 13 of the switching device 10 due to a failure of the switching device 10.

The control circuit 102 can also be called control electronics. The control circuit 102 may have at least one of the following functions: The control circuit 102 is configured to provide a current to the magnetic drive coil 144 of the magnetic drive 101 above an input threshold voltage. The control circuit 102 is configured to reduce the current flowing through the magnetic drive coil 144 to a sealing current after the transition from the switched-off state to the switched-on state that means after forming an impulse of the armature. The timer 105 controls the reduction of the coil current to the value of the sealing current. The control circuit 102 is designed to switch off a voltage provided to the magnetic drive coil 144 in the case that a control voltage becomes less than a predetermined minimal control voltage. The control circuit 102 is configured to provide safety functions in the case of overvoltage or of a voltage peak.

The auxiliary switch 140 is designed to control the function of the switching device 10. The control is performed by means of the separate mechanical auxiliary switch 140. The auxiliary switch 140 is coupled to the switching device 10 such that a movement for opening or closing of the armature and the contact bridge 16 of the switching device 10 is mechanically coupled by a catch or a pin to the movable contacts of the auxiliary switch 140. The function of the auxiliary switch 140 is optionally in a complementary manner in comparison to the function of the switching device 10. The auxiliary switch 140 may be realized as a mirror contact in comparison to the switching device 10. Thus, the auxiliary contacts of the auxiliary switch 140 are realized as normally closed contacts (NC contacts), if the switching device 10 has normally open contacts (NO contacts). In the case of opened contacts of the switching device 10, the contacts of the auxiliary switch 140 are in a closed state and vice versa.

The auxiliary switch 140 may optionally be integrated in the switching device 10, such as for example shown in FIG. 3. A movable guidance or slide bar of the contact bridge 16 of the switching device 10 is directly coupled to the armature of the magnetic drive 101. The mechanical coupling is realized in general by a plastic holder of a contact bridge carrier (at an appropriate place lateral or at the end being directed towards a cap). This guidance or slide bar is mechanically coupled with a corresponding guidance or slide bar of the contact bridge of the auxiliary switch 140. Thus, the further contact bridge 74 shown in FIG. 3 may be an example of an auxiliary contact bridge of the auxiliary switch 140.

Alternatively, the auxiliary switch 140 is realized as a separate switch having its own housing in this case, the auxiliary switch 140 may be reversibly coupled to an appropriate point of the switching device 10, for example by means of a screw connection or a clip connection. The state of the main contacts (which comprise the first and the second movable contacts 14, 15 of the switching device 10) can be determined by the complementary auxiliary switch 140 together with the control circuit 102 of the switching device 10. When the auxiliary contacts are in an open state, for example at a switched off voltage of the magnetic drive coil 144, then the main contacts of the switching device 10 are in a closed state. Thus, the on-board electronics of the vehicle receives the information that the switching device 10 has failed, for example in the form of welded main contacts, and that the power supply or the power circuit is in a non-safe state.

When the load current I reaches the threshold current, the magnetic force holding the drive is switched off by the magnetic drive 101 by a quick de-energization of the magnetic drive coil 144. By the quick de-energization the acting magnetic force for closing is reduced to a value below the force of the contact spring 91 as shown in FIGS. 1A and 3 such that quick opening the contact bridge 16 is initiated. The contact spring 91 is realized as a contact pressure spring. The contact spring 91 primarily provides a contact pressure force on the closed contacts. One or more than one further springs provide a forced separation of the armature and the magnet core. This or these springs may be realized as rejection pressure spring. This opening procedure can be tuned, improved, and/or optimized if the total moved mass of the system comprising the armature and the contact bridge 16 is provided at a selected value—for example by being constructively minimized. The mass of the contact bridge 16 is set such that a high velocity of opening is achieved. The armature and the magnet core comprise stacks of isolated electrical sheets having an appropriate selected thickness. The switching device 10 may have a period for opening the contacts 12 to 15 less than 2 milliseconds, even in the case of nominal currents in the level of several hundred ampere. The period for opening is in the region of 10 ms or higher in the case of a conventional switching device. A fail-back of the contact bridge 16 in a closed state is inhibited by the early switching-off of the magnet drive 101 (e.g., even where the early switching-off does not result in the magnet drive 101 opening the contacts before the dynamic lift-off, due to reducing closing force at the time of opening, and continued reductions through the trajectory of the contact bridge 16 after opening), and by the resilience.

In the case of a safety-relevant accident, the emergency signal AE is configured to switch off the switching device 10 independent from the level of the present load current I flowing through the switching device 10. The emergency signal AE can be realized as an external control signal or trigger signal. The emergency signal AE as shown in FIG. 4 may realize a quick and automatic switching-off of the load current I in an electric vehicle to prevent damage to persons or material by a current in the case of a crash. In such a case, the emergency signal AE can be generated by the acceleration sensor electronics of the vehicle. The acceleration sensor 145 is coupled to the emergency input 125. An electronic circuit may couple the acceleration sensor 145 to the emergency input 125. The emergency signal AE can be generated similar to a trigger signal for actuating an airbag. The emergency signal AE may be identical with the trigger signal for actuating an airbag. Advantageously, the switching-off of the load current 1 is already started in an early phase of a crash. A short circuit in the high voltage arrangement of the on-board power circuit is prevented, which reduces additional damage to the persons in the vehicle, to the vehicle itself, and de-energizes the electrical system for reduced risk to occupants and/or emergency personnel.

In certain embodiments, an override to the emergency input 125 may be provided—for example in certain applications where continued operations in spite of the risk of system damage and/or persons are nevertheless indicated. In certain embodiments, an override may be utilized by emergency personnel, for emergency vehicle applications, to limp a vehicle off a roadway or other dangerous environment, and/or in other high priority applications such as industrial or military equipment. In certain embodiments, an override may be implemented through control of the emergency input 125 and/or an auxiliary input. In certain embodiments, an override may require an authorization, a code input, a service tool, or other protections to make an override, even where present, unavailable for persons having general access to the system.

The switching device 10 is implemented as a remote-controlled DC switching device. The switching device 10 is fabricated as a compact device. The switching device 10 is configured to conduct and switch off bidirectional load currents and bidirectional overcurrents such as, for example, short-circuit currents.

The switching device 10 has a short switch-off time for the safe switching-off of short-circuit currents. The time between the pulse of a switch-off signal up to the complete opening the contacts 12 to 15 is less than 2.5 ms. The switching device 10 uses an electromagnetic drive and an electronic rapid de-excitation. In order to achieve this, the switching device 10 only uses a reduced moved mass. The moved mass may comprise the armature, the contact bridge 16 and parts connecting the armature to the contact bridge 16. The contact bridge 16 has a high contact pressure force and rejection pressure force. The magnetic circuit of the switching device 10 is realized as an arrangement with a low eddy current. A rapid de excitation may be performed without an external auxiliary energy supply.

The switching device 10 has an electromagnetic drive such as the magnetic drive 101 shown in FIG. 4 with a low value of a sealing power. The first and the second terminal contacts 17, 18 and the contact bridge 16 with the function of arc guiding and two arc extinguishing devices 21 to 24 for each contact pair, for both current directions, are configured for extinguishing the arcs in the case of a nominal current and for the guiding and extinguishing short-circuit arcs. The arc extinguishing devices 21 to 24 are realized as deionization arc extinguishing devices, abbreviated Deion extinguishing devices. The switching device 10 comprises a permanent magnet system 35 that is realized as a permanent magnetic blowout field arrangement. The permanent magnet system 35 is arranged between the contacts 12 to 15 and the arc extinguishing devices 21 to 24.

The switching arrangement 100 comprises the current sensing unit 115 having a current sensor. The current sensor may be a Hall sensor element, although the current sensor may be any type of current sensing device including at least a virtual sensor that calculates the current through other information available in the system, a Rogowski coil, and/or measured magnetic characteristics from inductive properties in the system. The current sensor may be arranged in the vicinity of the first or the second terminal contact 17, 18. The current sensing unit 115 is realized for the quick detection of a short-circuit current. The switching device 10 is configured to generate a magnetic blowout field or magnetic blowout fields by the contact bridge 16 having an S-shape in conjunction with a part of the terminal contact 17, 18. These magnetic blowout field or fields are designed to quickly move the arcs from the contacts 12 to 15 in the direction of the arc extinguishing devices 21 to 24, when the contacts 12 to 15 are in the process of opening, especially in the case of a short circuit. This is also achieved for arcs at the nominal current as well as for arcs at overcurrents (these arcs also reduce the lifetime of the switching device 10, since these are have an eroding and thus lifetime-limiting effect on the contacts 12 to 15). Such an overcurrent may be below a trigger level of the Hall sensor. The arc extinguishing devices are identical for both polarities of the load current I.

Various features of the present disclosure support reduced wear on the contacts over the life of the switching device 10, allowing for a greater number of operating cycles relative to previously known devices. Additionally, various features of the present disclosure support survival of the contacts through a number of short circuit or dynamic lift-off events, providing for a number of capabilities that are not available in fuse or fuse-only protection arrangements. For example, and without limitation, re-contact of the switching device 10 after a short circuit or dynamic lift-off event is possible, which may be utilized for emergencies and/or service operations. Additionally, an operational gap between a fuse operation current level and a contactor maximum current level exists in previously known systems, and is not present in the current system. The operational gap between the fuse operation current level and the contactor maximum current level for previously known systems is further complicated by variations in the designed load of a system—for example where a system supports multiple operating load thresholds, where a single switching device 10 configuration is to be installed on various systems having different operating loads, and/or where a system includes a high-current mode such as a quick charging mode.

The control circuit 102 can also be called drive electronics. The control circuit 102 provides a power supply to a current sensor, for example to a current sensing unit 115 that may be implemented as a Hall sensor. Moreover, the control circuit 102 evaluates the signal detected by the current sensing unit 115. Furthermore, the control circuit 102 is configured for the quick switching-off of the coil current in the case of a short circuit. The emergency input 125 is realized as an external signal input for the rapid switching-off of the coil current to achieve an opening of the load circuit in case of emergency. The emergency signal AE is implemented as a switch-off signal and may be generated by the airbag electronics of the vehicle in case of a crash.

The auxiliary switch 140 has a mirror contact function that is complementary to the switching device 10, namely to the main contacts that carry and switch the load current I. The auxiliary switch 140 is integrated in the switching device 10. Alternatively, the auxiliary switch 140 is realized as a separate switch that is mechanically coupled to the switching device 10, that means mechanically coupled to the main contacts 12 to 15 of the switching device 10. The auxiliary switch 140 is configured for the safe control of the function of the switching device 10.

The switching arrangement 100 may be implemented in an electric or partially electric vehicle. The vehicle includes electrical storage (e.g. a battery) and an electric motor providing motive power for the vehicle. The power bus 119 having the switching device 10 couples the electrical energy storage device to the electric motor. The switching device 10 combines a breaker and a relay. The switching device 10 comprises the magnetic drive 101. The switching arrangement 100 provides continuous (e.g., in the time domain, and also across a range of load current values) and selectable overcurrent protection above a critical current, while providing full rated operational current i to the vehicle motor. The switching arrangement 100 may be a hardware only device or may comprise a hardware and a controller using software. The switching arrangement 100 processes and/or handles the control signal AV and the emergency signal AE and responds via the control circuit 102 to perform selected operations such as to set the switching device 10 in a switched-on state or a switched-off state. The control circuit 102 may have a supply terminal for power supply of the control circuit or may receive its power via the control input 104. The switching device 10 may be switched off, when the control signal AV has the value 0 V.

The switching arrangement 100 may be used for different operating regimes, including pre charge operations (e.g. at power-on for a vehicle), powering operations for a load (e.g. providing motive power or auxiliary power for the vehicle), regeneration operations (e.g. refeeding power from a motive load or auxiliary load), and charging operations (e.g. connection of a dedicated charger to the vehicle). Thus, the polarity of the load current I depends on the acting power operating regime and may be different at different points of time.

In an alternative embodiment, a further emergency signal is provided to the emergency input 125.

In an alternative embodiment, a further control signal is provided to the control input 104.

Certain example procedures are described following. The example procedures can be utilized with any aspect of the present disclosure, including any systems, switching devices, arrangements, or controllers described herein. Procedures are described in the context of a schematic flow diagram illustrating certain operations, but operations may be combined in whole or part, added, omitted in whole or part, and/or rearranged in whole or part.

Figure 5:
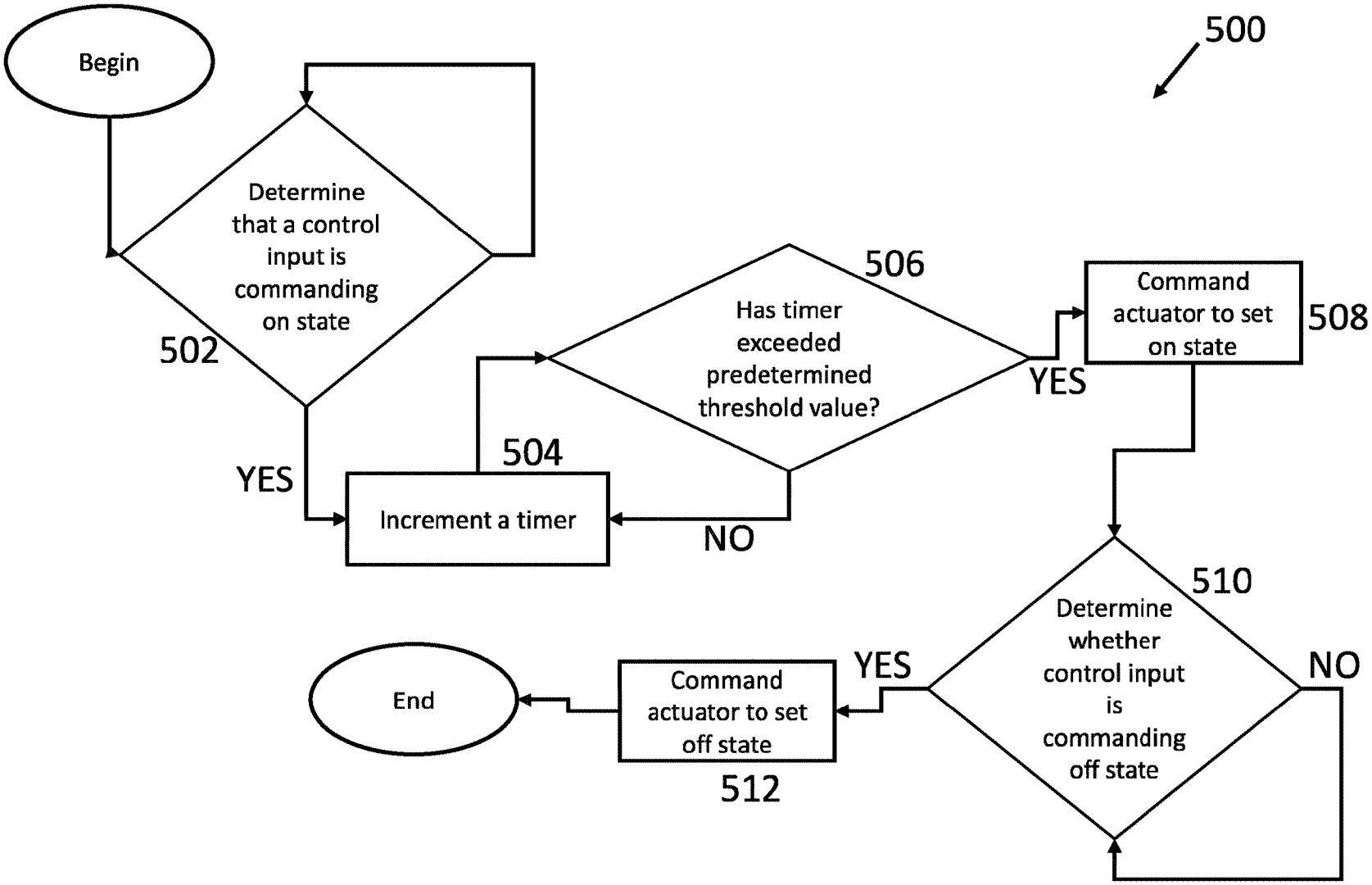
FIGS. 5-8 show example procedures used in the operation of a switching arrangement.

Referencing FIG. 5, an example procedure 500 includes an operation 502 to determine that a control input is commanding or requesting a switching device be set to a switched-on state, and an operation 504, in response to the operation 502 determining YES, to increment a timer. The example procedure 500 further includes an operation 506 to determine whether the timer has reached a predetermined threshold value (e.g., a predetermined turn-on time). In response to the operation 506 determining NO, the example procedure 500 continues operation 504 to increment the timer. In response to operation 508 determining YES, the example procedure 500 includes an operation 508 to command an actuator (e.g., by energizing a magnetic drive) to place the switching device in the switched-on state. The example procedure 500 further includes an operation 510 to determine whether the control input is commanding or requesting the switching device be set to a switched-off state, and/or whether the control input is no longer commanding or requesting the switching device be set to the switched-on state. The example procedure 500 repeats the operation 510, in response to the operation 510 determining NO, and includes operation 512 to command the actuator to place the switching device into the switched-off state in response to the operation 510 determining YES.

Figure 6:
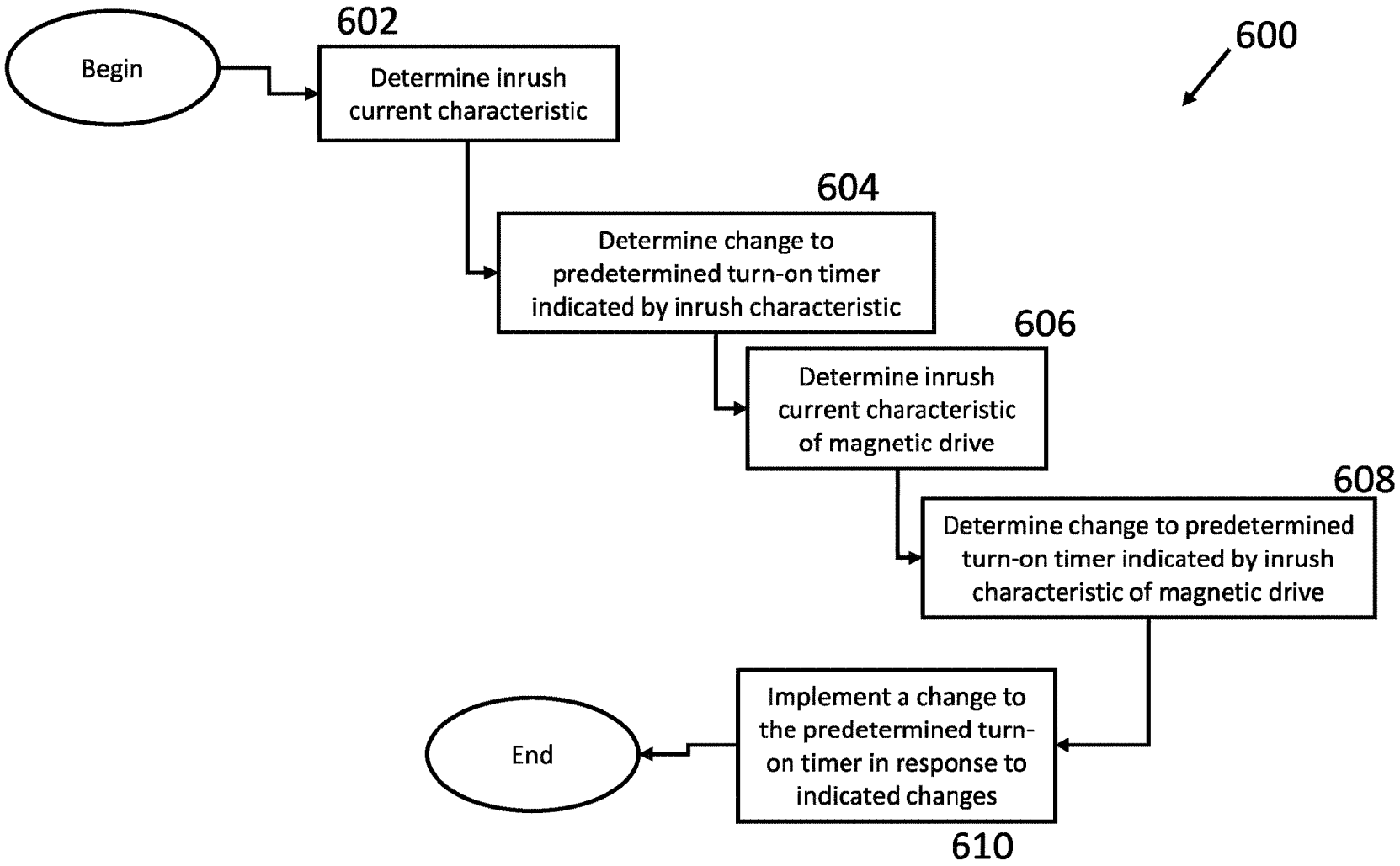

Referencing FIG. 6, an example procedure 600 includes an operation 602 to determine an inrush current characteristic during a pre-charge operation (e.g., after a control input commands or requests that the switching device be set to the switched-on state). The example procedure 600 further includes an operation 604 to determine whether a change to a predetermined turn-on time is indicated in response to the determined inrush current characteristic. For example, if the inrush current characteristic indicates that an earlier timer setting will not result in an inrush current peak exceeding a threshold, a change to a shorter predetermined turn-on time may be indicated, and if the inrush current characteristic indicates that the inrush current peak exceeds a threshold, especially at the end of the predetermined turn-on time when the actuator for the switching device would otherwise set the device to the switched-on state, a change to a longer predetermined turn-on time may be indicated. The example procedure 600 further includes an operation 606 to determine an inrush current characteristic of the magnetic drive after the actuator sets the switching device to the switched-on state, and an operation 608 to determine whether a change to the predetermined turn-on time is indicated in response to the inrush current characteristic of the magnetic drive. For example, if the inrush current characteristic of the magnetic drive indicates that an earlier timer setting will not result in an inrush current peak exceeding a threshold, a change to a shorter predetermined turn-on time may be indicated, and if the inrush current characteristic of the magnetic drive indicates that the inrush current peak experienced by the magnetic drive exceeds a threshold, a change to a longer predetermined turn-on time may be indicated. The example procedure 600 further includes an operation 610 to implement a change to the predetermined turn-on time in response to the changes indicated in operations 604, 608. In certain embodiments, the example procedure 600 may be utilized to set the predetermined threshold value for operation 506 of example procedure 500, either on a current operation 506 or a subsequent execution of operation 506.

Figure 7:
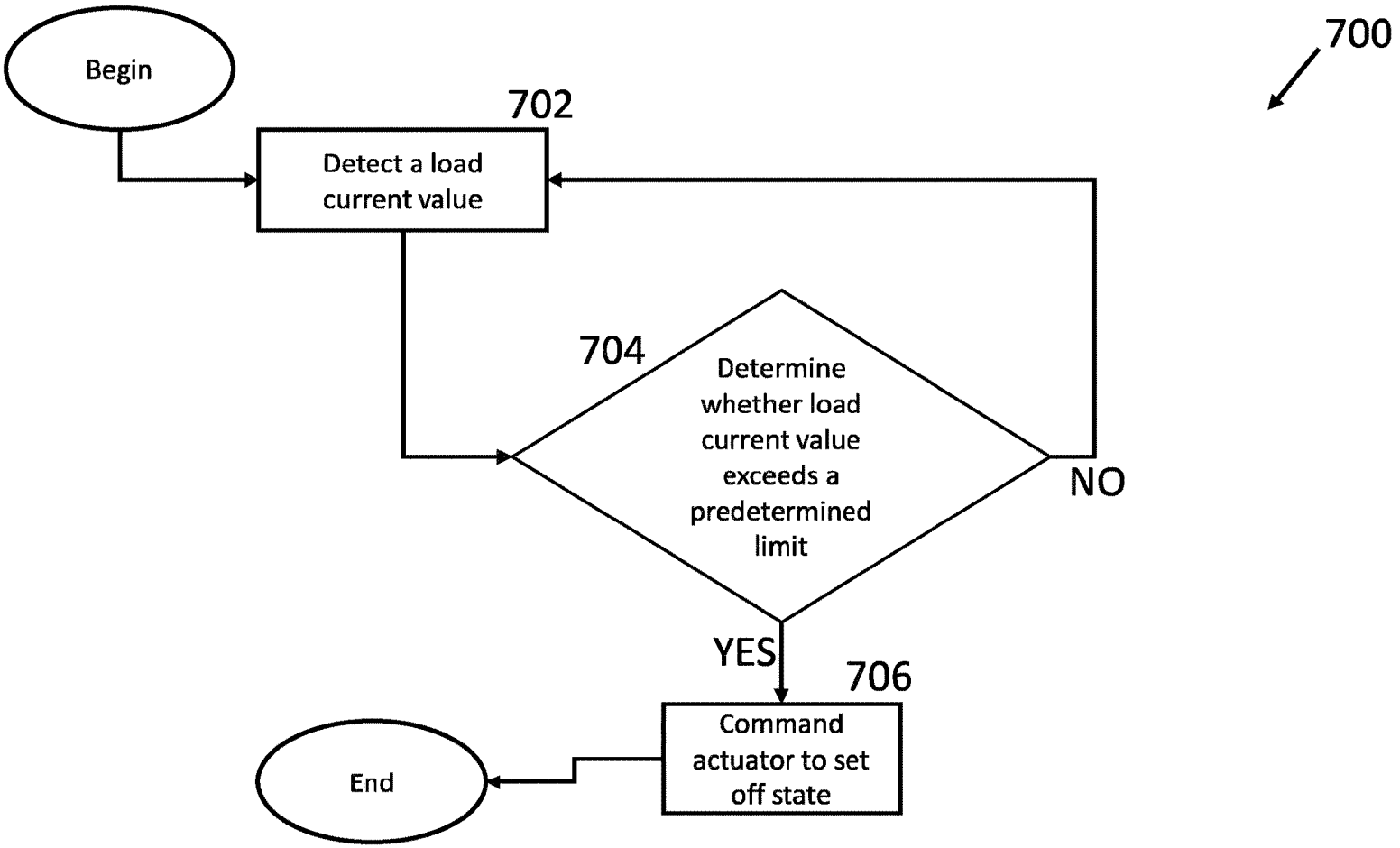

Referencing FIG. 7, an example procedure 700 includes an operation 702 to detect a value of a load current flowing through a switching device. The example procedure 700 further includes an operation 704 to determine whether the load current exceeds a predetermined limit, which may be predetermined in respond to operating conditions, and an operation 706 to command an actuator to set the switching device to a switched-off state in response to operation 704 determining YES. In certain embodiments, the example procedure 700 includes returning to operation 702 in response to operation 704 determining NO.

Figure 8:
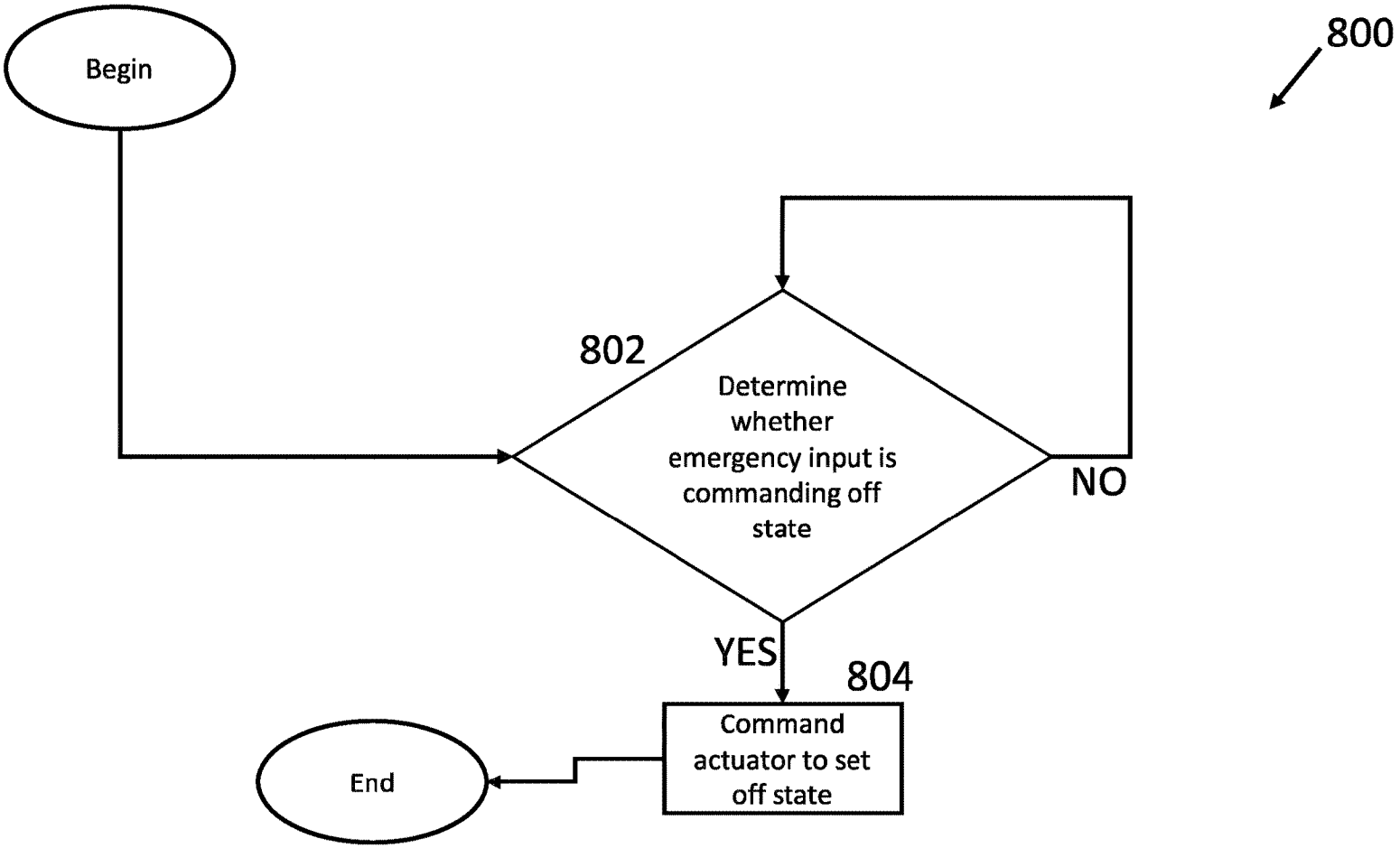

Referencing FIG. 8, an example procedure 800 includes an operation 802 to determine that an emergency input is commanding the switching device to a switched-off state. In response to operation 802 determining YES, the example procedure 800 further includes an operation 804 to command an actuator to set the switching device to the switched-off state. In response to operation 804 determining NO, the example procedure 800 returns to operation 802.

Figure 9A:
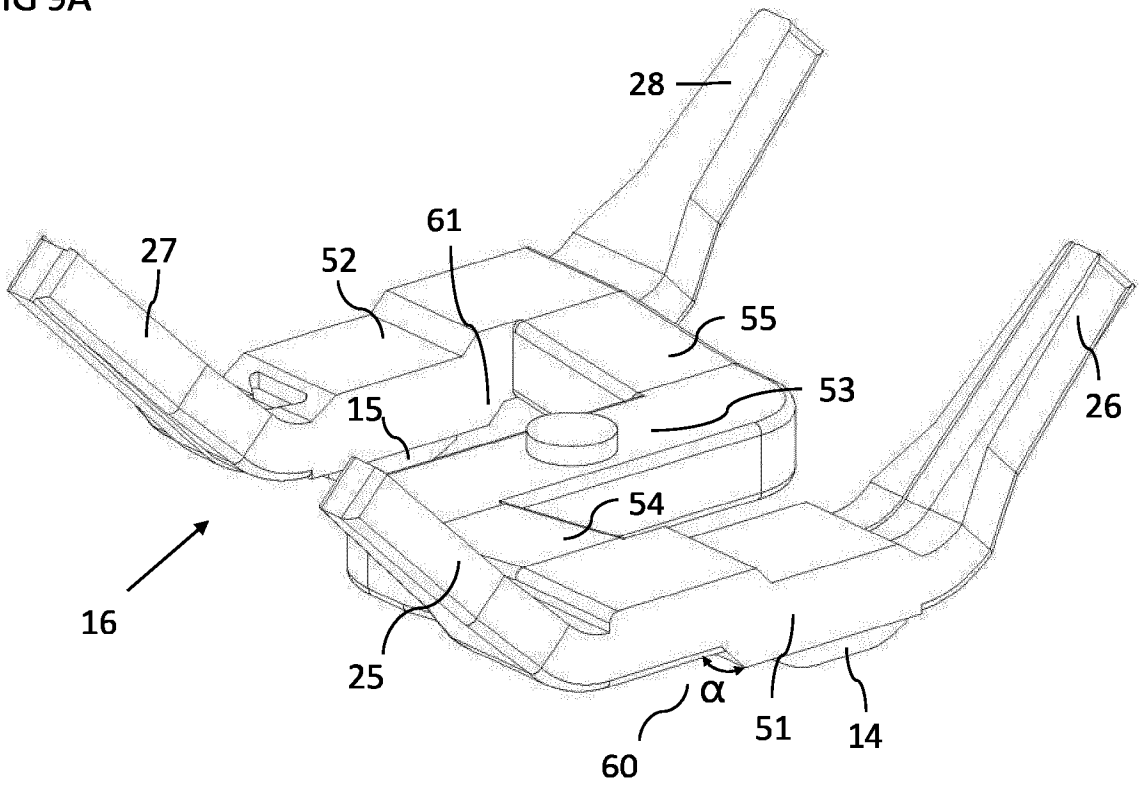
FIGS. 9 A, 9B and 10 show further examples of a contact bridge.

FIG. 9A shows an example of the contact bridge 16 which is a further development of the examples shown in FIGS. 1A to IE and 3. The contact bridge 16 obtains some bending. The contact bridge 16 has a first and a second step 60, 61. The first outer part 51 of the contact bridge 16 comprises the first step 60 and the second outer part 52 of the contact bridge 16 comprises the second step 61. Thus, the first step 60 is located in the first outer part 51 and the second step 61 is located in the second outer part 52. The first and the second step 60, 61 realize a small bending of the contact bridge 16. The height of the first step 60 and the height of the second step 61 may be less than 10 mm or less than 5 mm or less than 3 mm. The surface of the steps 60, 61 may have an angle a between 120 degree and 170 degree or between 135 degree and 165 degree or between 150 degree and 160 degree to a surface of another region of the first and the second outer part 51, 52 (an angle a of 180 degree would mean that the steps 60, 61 are not existing).

The first step 60 increases a distance of the first outer part 51 to the first terminal contact 17. The second step 61 increases a distance of the second outer part 52 to the second terminal contact 18. Thus, also in case of a small misalignment of the contact bridge 16 to the first and the second terminal contact 17, 18, a generation of any arc at a not-predetermined spot of the contact bridge 16 is avoided. The contact bridge 16 may optionally comprise further bending. The load current I flowing through the contact bridge 16 between the first and the second moveable contact 14, 15 may slightly vary from an exact planar arrangement. Since the height of the steps 60, 61 is small and the first and the second step 60, 61 realize a smooth bending, the path of the load current I that flows through the contact bridge 16 between the first and the second movable contact 14, 15 in the switched-on state at least approximately extends in the first plane.

Figure 9B:
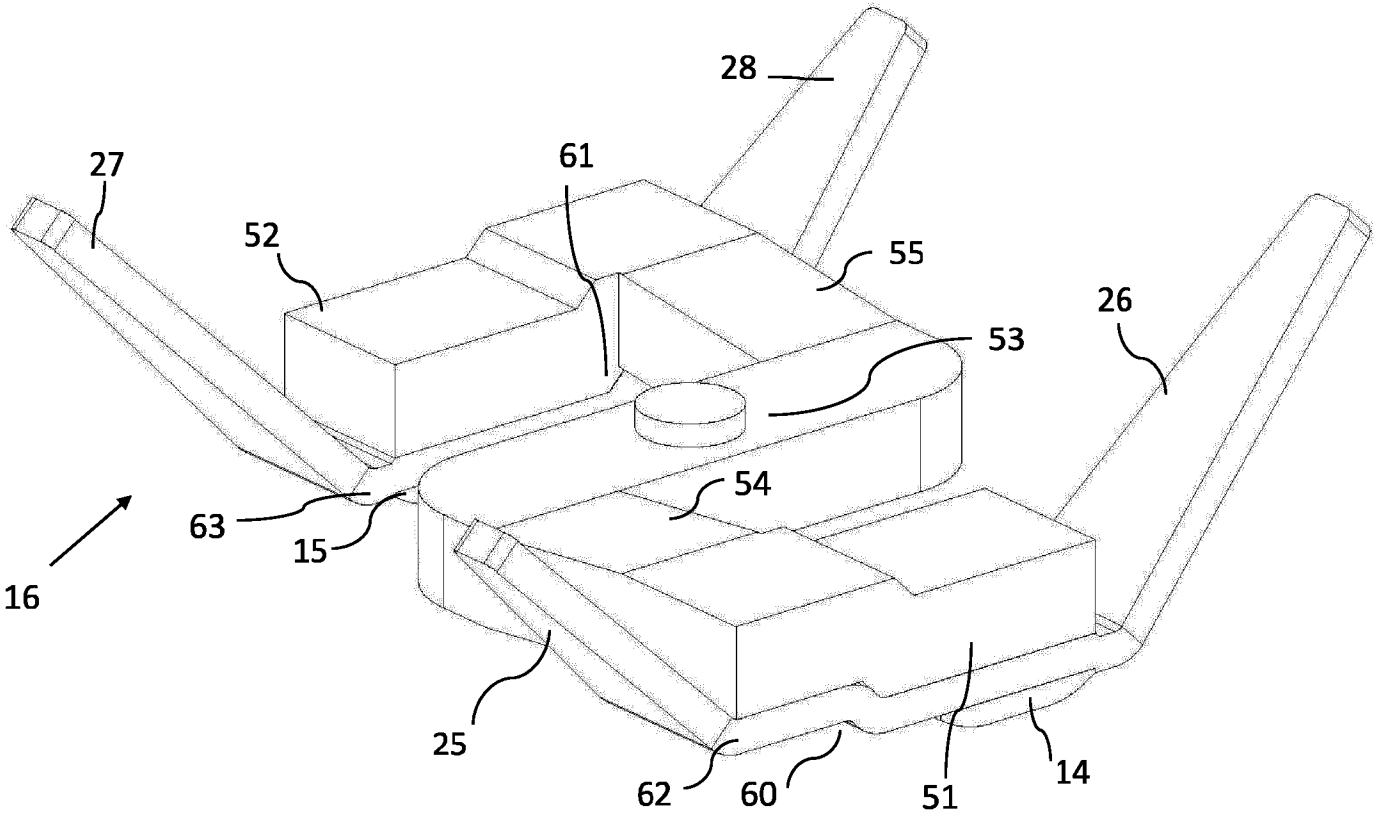

FIG. 9B shows an example of the contact bridge 16 which is a further development of the examples shown in FIGS. 1A to IE, 3 and 9 A. The switching device 10 comprises a first and a second metal sheet 62, 63 that are fixed to the contact bridge 16. The first and the second metal sheet 62, 63 are between the contact bridge 16 and the first and the second terminal contact 17, 18 The first and the second metal sheet 62, 63 may e.g. be made out of iron or steel.

The first metal sheet 62 is attached to the first outer part 51. The first metal sheet 62 is on a surface of the contact bridge 16 opposing the first terminal contact 17. The first movable contact 14 is on the first metal sheet 62. The first pair of arc runners 25, 26 are realized by the first metal sheet 62. Correspondingly, the second metal sheet 63 is attached to the second outer part 52. The second metal sheet 63 is on a surface of the contact bridge 16 opposing the second terminal contact 18. The second movable contact 15 is on the second metal sheet 63. The second pair of arc runners 27, 28 are realized by the second metal sheet 63.

Figure 10:
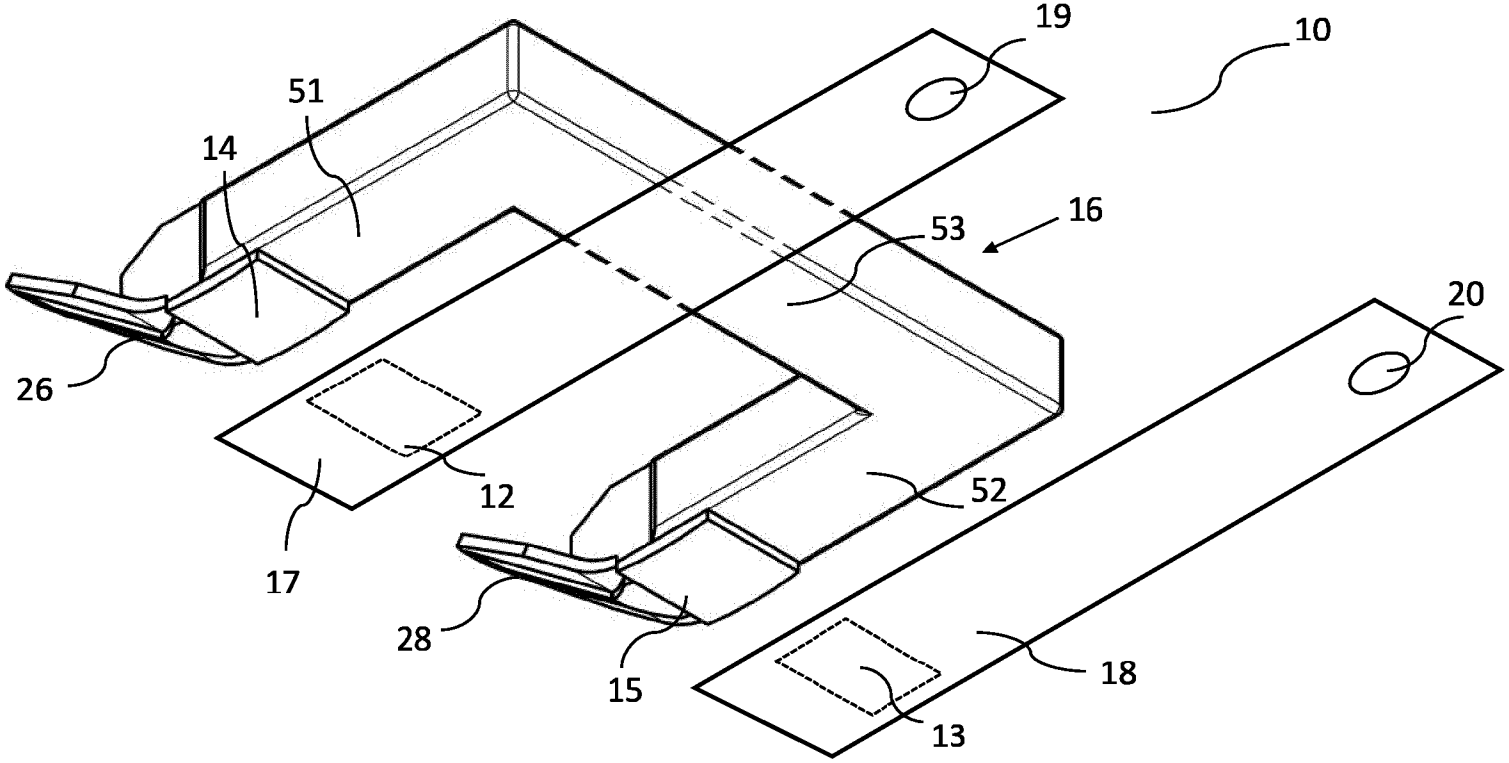

FIG. 10 shows an example of the contact bridge 16 which is a further development of the examples shown in the Figures above. The contact bridge 16 has the form of a C-shape. Thus, the load current I that flows through the contact bridge 16 between the first and the second movable contact 14, 15 in the switched-on state has a curved path in the form of a C-shape. The switching device 10 comprises an arc runner 26 near the first movable contact 14 and an arc runner 28 near the second movable contact 15. Thus, the number of arc runners may be reduced e.g. in comparison to FIGS. 1A to IE, 9A and 9B.

In FIG. 10, the first and the second terminal contact 17, 18 are only indicated for orientation. The first and the second terminal contact 17, 18 may be contacted from one side of the switching device 10 (similarly as shown in FIG. 3) and may not be contacted in a diagonal manner (as shown in FIGS. 1A and 1E). The load current 1 that flows through the first terminal contact 17, the first arc generated between the first fixed contact 12 and the first movable contact 14 at a transition between the switched-on state and the switched-off state of the switching device 10 and the first outer part 51 of the contact bridge 16 has a U-form. Similarly, the load current 1 flowing through the second outer part 52, the second movable contact 15, the second arc, the second fixed contact 13 and the second terminal contact 18 has a U-form. Thus, a blowout field is generated in case of an arc also at a contact bridge 16 with a C-shape.

The methods, procedures, systems, and arrangements described herein may be deployed in part or in whole through a machine having one or more computing devices such as a computer, controller, processor, and/or circuit that executes computer readable instructions, program codes, instructions, and/or includes hardware configured to functionally execute one or more operations of the methods and systems herein. The terms computer, controller, processor, and/or circuit, as utilized herein, should be understood broadly.

Examples of such devices include a computer of any type, capable to access instructions stored in communication thereto such as upon a non-transient computer readable medium, whereupon the computer performs operations of the computing device upon executing the instructions. In certain embodiments, such instructions themselves comprise a computing device. Additionally or alternatively, a computing device may be a separate hardware device, one or more computing resources distributed across hardware devices, and/or may include such aspects as logical circuits, embedded circuits, sensors, actuators, input and/or output devices, network and/or communication resources, memory resources of any type, processing resources of any type, and/or hardware devices configured to be responsive to determined conditions to functionally execute one or more operations of methods, system, and arrangements herein.

Certain operations described herein include detecting, determining, receiving, and/or determining one or more values, parameters, inputs, data, or other information. Any such operations include, without limitation: reading a sensed value; receiving an electrical input representing the value; receiving data via a user input; receiving data over a network of any type; reading a data value from a memory location in communication with the receiving device; utilizing a default value as a received data value; estimating, calculating, or deriving a data value based on other information available to the receiving device; and/or updating any of these in response to a later received data value. In certain embodiments, a data value may be received by a first operation, and later updated by a second operation, as part of the receiving a data value. For example, when the primary input is down, such as when: information communications are down, intermittent, or interrupted; and/or when a first sensor or primary input device is not operational, in a fault condition, or the like, an auxiliary operation to receive the information may be performed (e.g., using a virtual sensor, an alternate information source, etc.), and when the primary input is restored, the primary operation to receive the information may be resumed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

10 switching device
12 first fixed contact
13 second fixed contact

14 first movable contact
15 second movable contact
16 contact bridge
17 first terminal contact
18 second terminal contact
19, 20 terminal connection hole 21 to 24 arc extinguishing device
25 to 28 arc runner
30 splitter plate
31 holder
35 permanent magnet system
36 permanent magnet
37 inner pole plate
38 outer pole plate
51 to 55 parts of contact bridge
57, 58 semicircle
60, 61 step
62, 63 metal sheet
70, 71 further fixed contact
72, 73 further movable contact
74 further contact bridge
75 to 78 further arc runner
79 to 82 further arc extinguishing device 83, 84 further terminal contact 90 contact bridge carrier
91, 92 contact spring
100 switching arrangement
101 magnetic drive
102 control circuit:
103 driver
104 control input
105 timer
106, 126 surge protection unit
107 polarity protection unit
108, 130 filter
109 first trigger level detector
110 control unit
111 de-energizing unit
112 further trigger level detector
113 control input
115 current sensing unit
117, 118 terminal lead
119 power bus
120 trigger level detector
125 emergency input
127 emergency trigger level detector
131 DC-to-DC converter
132 decoupling unit
134 regulation unit
135 amplifier
140 auxiliary switch
141 control detector
142, 143 further current line
144 magnetic drive coil
145 acceleration sensor
AV control signal
AE emergency signal
B, BL magnetic field
ER error signal
I load current
M direction of movement
SI, SD, ST signal

The invention claimed is:

1. A switching device, comprising:

a first fixed contact;

a second fixed contact;

a contact bridge;

a first movable contact and a second movable contact that are arranged at the contact bridge;

a first terminal contact on which the first fixed contact is mounted; and a second terminal contact on which the second fixed contact is mounted, wherein the first fixed contact is in contact with the first movable contact and the second fixed contact is in contact with the second movable contact in a switched-on state of the switching device, wherein the first fixed contact is free of contact with the first movable contact and the second fixed contact is free of contact with the second movable contact in a switched-off state of the switching device, wherein a path of a load current that flows through the contact bridge between the first movable contact and the second movable contact in the switched-on state extends in a first plane, wherein a movement of the contact bridge between the switched-on state and the switched-off state has a direction that is perpendicular to the first plane, wherein the path of the load current that flows through the contact bridge between the first movable contact and the second movable contact in the switched-on state has at least one path in the first plane comprising an S-shaped path, a zig-zag path, a Z-shaped path, a C-shape, a path comprising two connected semicircles along the first plane, or a path twice curved in opposite directions along the first plane, wherein a main direction of the first terminal contact is parallel to a main direction of the second terminal contact;

wherein a straight line running between the first movable contact and the second movable contact is across the main direction of the first terminal contact, and wherein the load current, which flows through the first terminal contact, flows through a first arc, which is generated between the first fixed contact and the first movable contact at a transition between the switched-on state and the switched-off state of the switching device, flows through a first outer part of the contact bridge, and flows towards at least one of a first pair of arc runners associated with the first part of the contact bridge, has a U-form.

2. The switching device according to claim 1, Wherein the path of the load current that flows through the contact bridge in the switched on-state extends laterally and longitudinally in the first plane from the first movable contact to the second movable contact, wherein as the path traverses from the first moveable contact to the second moveable contact, at least a part of the path includes a first portion that extends in a first direction, then a second portion that extends in a second direction that is opposite the first direction, and then a third portion that extends in the first direction.

3. The switching device according to claim 1, further comprising:

the first pair of arc runners, which are arranged at the first outer part of the contact bridge near the first movable contact, and which are movable with the contact bridge; and a second pair of arc runners, which are arranged at a second outer part of the contact bridge near the second movable contact, and which are movable with the contact bridge.

4. The switching device according to claim 1, further comprising:

a first pair of arc extinguishing devices configured to extinguish a first arc originating between the first fixed contact and the first movable contact; and a second pair of arc extinguishing devices configured to extinguish a second arc originating between the second fixed contact and the second movable contact.

5. The switching device according to claim 1, further comprising:

a permanent magnet system comprising an inner pole plate, an outer pole plate, and a permanent magnet that is arranged between the inner pole plate and the outer pole plate.

6. The switching device according to claim 5, wherein the inner pole plate is at least partially U-shaped and the outer pole plate is at least partially U-shaped.

7. The switching device according to claim 5, wherein the first fixed contact and the first movable contact are between the inner pole plate and the outer pole plate in the switched-on state and in the switched-off state of the switching device, and wherein the second fixed contact and the second movable contact are between the inner pole plate and the outer pole plate in the switched-on state and in the switched-off state of the switching device.

8. A switching arrangement, comprising:

the switching device according to claim 1;

a magnetic drive coupled to the contact bridge of the switching device; and a control circuit having a control input, an emergency input, and at least one output coupled to the magnetic drive, wherein the control circuit is configured to set the switching device in the switched-on state or in the switched-off state depending on a control signal provided to the control input, and wherein the control circuit is configured to set the switching device in the switched-off state depending on an emergency signal provided to the emergency input.

9. The switching arrangement according to claim 8, wherein the control circuit comprises:

a current sensing unit configured to measure the load current flowing through the switching device; and a trigger level detector having an input coupled to an output of the current sensing unit and an output configured to provide a trigger signal, wherein the control circuit is configured to set the switching device in the switched-off state as a function of the trigger signal.

10. The switching arrangement according to claim 8, further comprising:

an auxiliary switch or auxiliary contacts, wherein the magnetic drive is additionally coupled to the auxiliary switch or the auxiliary contacts.

11. The switching device according to claim 1, wherein the first moveable contact and the second moveable contact extend outward from a main body of the contact bridge in a direction perpendicular to the first plane, and wherein the main body of the contact bridge is, in the first plane, S-shaped, zig-zag shaped, Z-shaped, C-shaped, made of two connected semicircles along the first plane, or shaped with two curves in opposite directions along the first plane.

12. A switching device, comprising:

a first fixed contact;

a second fixed contact;

a contact bridge;

a first movable contact and a second movable contact that are arranged at the contact bridge;

a first terminal contact on which the first fixed contact is mounted; and a second terminal contact on which the second fixed contact is mounted, wherein the first fixed contact is in contact with the first movable contact and the second fixed contact is in contact with the second movable contact in a switched-on state of the switching device, wherein the first fixed contact is free of contact with the first movable contact and the second fixed contact is free of contact with the second movable contact in a switched-off state of the switching device, wherein a path of a load current that flows through the contact bridge between the first movable contact and the second movable contact in the switched-on state extends in a first plane, wherein a movement of the contact bridge between the switched-on state and the switched-off state has a direction that is perpendicular to the first plane, wherein a main body of the contact bridge is, in the first plane, S-shaped, zig-zag shaped, Z-shaped, C-shaped, made of two connected semicircles along the first plane, or shaped with two curves in opposite directions along the first plane, wherein the path of the load current that flows through the contact bridge between the first movable contact and the second movable contact in the switched-on state has at least one path in the first plane comprising an S-shaped path, a zig-zag path, a Z-shaped path, a C-shape, a path comprising two connected semicircles along the first plane, or a path twice curved in opposite directions along the first plane, wherein a main direction of the first terminal contact is parallel to a main direction of the second terminal contact, wherein a straight line running between the first movable contact and the second movable contact is across the main direction of the first terminal contact, and wherein the load current, which flows through the first terminal contact, flows through a first arc, which is generated between the first fixed contact and the first movable contact at a transition between the switched-on state and the switched-off state of the switching device, flows through a first outer part of the contact bridge, and flows towards at least one of a first pair of arc runners associated with the first part of the contact bridge, has a U-form.

13. The switching device according to claim 1, wherein the path of the load current that flows through the contact bridge between the first movable contact and the second movable contact in the switched-on state first extends in at least partially in first direction, then at least partially in a direction perpendicular to the first direction, then at least partially in a second direction that is opposite the first direction, then at least partially in the direction perpendicular to the first direction, and then at least partially in the first direction.

14. The switching device according to claim 1, wherein the path of the load current that flows through the contact bridge between the first movable contact and the second movable contact in the switched-on state first extends in a first direction to a first location, then in a second direction that is opposite the first direction to a second location, and then in the first direction to a third location that is different from the first location.

15. The switching device according to claim 1, wherein:

a first arc between the first terminal contact, the first fixed contact, the first moveable contact, and a first outer part of the contact bridge forms a first magnetic field loop; and a second arc between a second outer part of the contact bridge, the second movable contact, the second fixed contact, and the second terminal contact forms a second magnetic field loop.

16. The switching device according to claim 15, wherein:

the first arc is configured to be moved away from the contact bridge to be extinguished by a first pair of arc extinguishing devices by the first magnetic field loop; and the second arc is configured to be moved away from the contact bridge to be extinguished by a second pair of arc extinguishing devices by the second magnetic: field loop.

17. A switching device, comprising:

a first fixed contact;

a second fixed contact;

a contact bridge;

a first movable contact and a second movable contact that are arranged at the contact bridge;

a first terminal contact on which the first fixed contact is mounted; and a second terminal contact on which the second fixed contact is mounted, wherein the first fixed contact is configured to be in contact with the first movable contact and the second fixed contact is configured to be in contact with the second movable contact in a switched-on state of the switching device, wherein the first fixed contact is configured to be free of contact with the first movable contact and the second fixed contact is configured to be free of contact with the second movable contact in a switched-off state of the switching device, wherein the contact bridge comprises a main body that is configured to provide a path for a load current that flows through the contact bridge between the first movable contact and the second movable contact in the switched-on state, the path and the contact bridge extending laterally and longitudinally in a first plane, wherein the contact bridge is configured to move between the switched-on state and the switched-off state in a movement direction that is perpendicular to the first plane, wherein the main body comprises a first extent that extends, in the first plane, away at least partially in a first direction from a first portion of the main body to a second portion of the main body, a second extent that extends, in the first plane, away at least partially in a second direction from the second portion to a third portion of the main body, the second direction being opposite to the first direction, and a third extent that extends, in the first plane, away at least partially in the first direction from the third portion to a fourth portion of the main body, and wherein the first movable contact is arranged on the first portion of the main body, the second moveable contact is arranged on the fourth portion of the main body, and the first portion is, in the first plane, laterally and longitudinally spaced apart from the fourth portion.

18. The switching device according to claim 17, the switching device further comprising a permanent magnet system comprising an inner pole plate, an outer pole plate, and a permanent magnet that is arranged between the inner pole plate and the outer pole plate, wherein the main body is arranged to traverse around at least a first section of the inner pole plate as the main body extends from the first portion to the fourth portion such that the first section of the inner pole plate is interposed between the first portion and the third portion along an imaginary straight line that extends, in the first plane, in a third direction between the first portion and the third portion, the third direction being perpendicular to the first direction and perpendicular to the movement direction.

19. The switching device according to claim 18, wherein the main body is further arranged to traverse around at least a second section of the inner pole plate as the main body extends from the first portion to the fourth portion such that the second section of the inner pole plate is interposed between the second portion and the third portion along another imaginary straight line that extends in the third direction between the second portion and the forth portion.

* * * * *